US008839481B2

(12) United States Patent
Moskovich et al.

(10) Patent No.: US 8,839,481 B2
(45) Date of Patent: Sep. 23, 2014

(54) ORAL CARE IMPLEMENT

(71) Applicant: Colgate-Palmolive Company, New York, NJ (US)

(72) Inventors: Robert Moskovich, East Brunswick, NJ (US); Kenneth Wawguespack, North Brunswick, NJ (US); Bruce Michael Russell, Howell, NC (US)

(73) Assignee: Colgate-Palmolive Company, New York, NY (US)

( * ) Notice: Subject to any disclaimer, the term of this patent is extended or adjusted under 35 U.S.C. 154(b) by 0 days.

(21) Appl. No.: 13/888,825

(22) Filed: May 7, 2013

(65) Prior Publication Data

US 2013/0247316 A1 Sep. 26, 2013

Related U.S. Application Data

(63) Continuation of application No. 13/162,915, filed on Jun. 17, 2011, now Pat. No. 8,561,247, which is a continuation of application No. 12/751,109, filed on Mar. 31, 2010, now Pat. No. 7,975,346, which is a (Continued)

(51) Int. Cl.

| | |
|---|---|
| ***A46B 9/04*** | (2006.01) |
| ***A46B 5/00*** | (2006.01) |
| ***A46B 15/00*** | (2006.01) |
| ***A46B 9/02*** | (2006.01) |

(52) U.S. Cl.

CPC ..... *A46B 5/0025* (2013.01); *A46B 15/0055* (2013.01); *A46B 9/026* (2013.01); *A46B 5/0029* (2013.01); *A46B 2200/1066* (2013.01); *A46B 15/0081* (2013.01)

USPC ..... 15/167.1; 15/201

(58) Field of Classification Search

USPC ..... 15/167.1, 201

See application file for complete search history.

(56) References Cited

U.S. PATENT DOCUMENTS

| | | | |
|---|---|---|---|
| 301,644 | A | 7/1883 | Thompson |
| 585,358 | A | 6/1897 | Gould |

(Continued)

FOREIGN PATENT DOCUMENTS

| | | |
|---|---|---|
| CA | 2004029 | 5/1990 |
| CH | 99738 | 6/1923 |

(Continued)

OTHER PUBLICATIONS

Computer generated English Translation of JP 2001-190333.

(Continued)

*Primary Examiner* — Laura C Guidotti

(74) *Attorney, Agent, or Firm* — Thibault Fayette

(57) ABSTRACT

An oral care implement having a cleaning element carrier. In one embodiment, the implement comprises a handle; a head coupled to the handle, the head having a longitudinal axis and a base structure with a front surface; a cleaning element carrier having a top surface and a bottom surface supported above the front surface of the base structure so that a gap exists between the bottom surface of the cleaning element carrier and the front surface of the base structure; a plurality of first cleaning elements extending from the top surface of the cleaning element carrier; at least one second cleaning element extending from the front surface of the base structure beyond the top surface of the cleaning element carrier; and wherein the second cleaning element and the cleaning element carrier are in transverse alignment.

18 Claims, 23 Drawing Sheets

Related U.S. Application Data

(63) continuation of application No. 11/429,677, filed on May 8, 2006, now Pat. No. 7,841,041, which is a continuation-in-part of application No. 11/256,790, filed on Oct. 24, 2005, now Pat. No. 7,614,111, which is a continuation-in-part of application No. 11/122,224, filed on May 5, 2005, now Pat. No. 7,845,042, which is a continuation-in-part of application No. 10/768,363, filed on Jan. 30, 2004, now Pat. No. 7,703,163, which is a continuation-in-part of application No. 10/697,213, filed on Oct. 30, 2003, now Pat. No. 7,757,326, said application No. 11/429,677 is a continuation-in-part of application No. 11/019,671, filed on Dec. 23, 2004, now Pat. No. 7,721,376, which is a continuation-in-part of application No. 10/869,922, filed on Jun. 18, 2004, now Pat. No. 7,143,462, which is a continuation-in-part of application No. 10/601,106, filed on Jun. 20, 2003, now abandoned, said application No. 11/019,671 is a continuation-in-part of application No. PCT/US03/30633, filed on Sep. 26, 2003, which is a continuation-in-part of application No. PCT/US03/29497, filed on Sep. 17, 2003, which is a continuation-in-part of application No. 29/189,729, filed on Sep. 10, 2003, now Pat. No. Des. 517,812, which is a continuation-in-part of application No. 10/989,267, filed on Nov. 17, 2004, now Pat. No. 7,607,189, which is a continuation-in-part of application No. 29/209,242, filed on Jul. 14, 2004, now abandoned, said application No. 11/429,677 is a continuation-in-part of application No. 10/989,267, filed on Nov. 17, 2004, now Pat. No. 7,607,189, which is a continuation-in-part of application No. 29/209,242, filed on Jul. 14, 2004, now abandoned, which is a continuation-in-part of application No. 29/209,244, filed on Jul. 14, 2004, now abandoned, which is a continuation-in-part of application No. 10/902,257, filed on Jul. 30, 2004, now Pat. No. 7,047,591, which is a continuation-in-part of application No. PCT/US03/29497, filed on Sep. 17, 2003, said application No. 10/902,257 is a continuation-in-part of application No. 29/189,729, filed on Sep. 10, 2003, now Pat. No. Des. 517,812, said application No. 11/429,677 is a continuation-in-part of application No. 11/053,583, filed on Feb. 8, 2005, now Pat. No. 7,360,270, which is a continuation of application No. PCT/US03/24878, filed on Aug. 8, 2003, which is a continuation-in-part of application No. 11/053,589, filed on Feb. 8, 2005, now Pat. No. 7,725,981, which is a continuation of application No. PCT/US03/24879, filed on Aug. 8, 2003.

(60) Provisional application No. 60/414,117, filed on Sep. 27, 2002, provisional application No. 60/418,776, filed on Oct. 16, 2002, provisional application No. 60/419,425, filed on Oct. 18, 2002, provisional application No. 60/412,290, filed on Sep. 20, 2002, provisional application No. 60/402,162, filed on Aug. 9, 2002, provisional application No. 60/402,170, filed on Aug. 9, 2002, provisional application No. 60/402,670, filed on Aug. 12, 2002, provisional application No. 60/402,165, filed on Aug. 9, 2002.

(56) References Cited

U.S. PATENT DOCUMENTS

| | | | |
|---|---|---|---|
| 697,336 | A | 4/1902 | Hagerty |
| 726,727 | A | 4/1903 | Mills |
| 758,764 | A | 5/1904 | MacLeod |
| 759,490 | A | 5/1904 | Yates |
| 803,995 | A | 11/1905 | Davenport |
| 864,054 | A | 8/1907 | Peck |
| 907,842 | A | 12/1908 | Meuzies |
| 914,501 | A | 3/1909 | McEachern |
| 958,371 | A | 5/1910 | Danek |
| 1,002,468 | A | 9/1911 | Strangman |
| 1,006,630 | A | 10/1911 | Clarke |
| 1,007,328 | A | 10/1911 | Brandstetter |
| 1,022,920 | A | 4/1912 | Anderson |
| 1,125,532 | A | 1/1915 | Himmel |
| 1,128,139 | A | 2/1915 | Hoffman |
| 1,132,326 | A | 3/1915 | Fouyer |
| 1,142,698 | A | 6/1915 | Crumbaugh |
| 1,153,409 | A | 9/1915 | Wheeler |
| 1,191,556 | A | 7/1916 | Blake |
| 1,251,250 | A | 12/1917 | Libby |
| 1,268,544 | A | 6/1918 | Cates |
| 1,327,757 | A | 1/1920 | Eggers |
| 1,327,807 | A | 1/1920 | Burleigh |
| 1,369,966 | A | 3/1921 | Cosens et al. |
| 1,405,279 | A | 1/1922 | Cassedy |
| 1,466,723 | A | 9/1923 | Izawa |
| 1,470,710 | A | 10/1923 | Davis |
| 1,495,675 | A | 5/1924 | Colt |
| 1,588,785 | A | 6/1926 | Van Sant |
| 1,598,224 | A | 8/1926 | Van Sant |
| 1,616,484 | A | 2/1927 | Beynon |
| 1,620,330 | A | 3/1927 | Douglass |
| 1,639,880 | A | 8/1927 | Butler |
| 1,658,706 | A | 2/1928 | Carrott |
| D75,971 | S | 8/1928 | Fatjbebt |
| 1,688,581 | A | 10/1928 | Glassman |
| 1,704,564 | A | 3/1929 | Friedland |
| 1,705,109 | A | 3/1929 | Essbach |
| 1,728,956 | A | 9/1929 | Darmitzel |
| 1,741,143 | A | 12/1929 | Chin |
| 1,770,195 | A | 7/1930 | Burlew |
| 1,796,001 | A | 3/1931 | Church |
| 1,796,641 | A | 3/1931 | Zimmerman et al. |
| 1,816,582 | A | 7/1931 | Heron |
| 1,817,585 | A | 8/1931 | Samuel |
| 1,833,555 | A | 11/1931 | Bell et al. |
| 1,860,924 | A | 5/1932 | Cooke |
| 1,861,347 | A | 5/1932 | Johnson |
| 1,872,832 | A | 8/1932 | Silverberg |
| 1,891,864 | A | 12/1932 | Barrett |
| 1,892,068 | A | 12/1932 | Metzler |
| 1,894,509 | A | 1/1933 | Booth |
| 1,903,161 | A | 3/1933 | Barkan |
| 1,024,152 | A | 8/1933 | Coney et al. |
| 1,927,365 | A | 9/1933 | Frolio |
| 1,928,328 | A | 9/1933 | Carpenter |
| 1,976,271 | A | 10/1934 | Vachoux |
| 1,993,662 | A | 3/1935 | Green |
| 1,993,763 | A | 3/1935 | Touchstone |
| 2,003,243 | A | 5/1935 | Campbell et al. |
| 2,028,011 | A | 1/1936 | Raymond |
| D99,352 | S | 4/1936 | Grapp |
| 2,042,239 | A | 5/1936 | Planding |
| 2,049,956 | A | 8/1936 | Greenberg |
| 2,059,914 | A | 11/1936 | Rosenberg |
| 2,079,728 | A | 5/1937 | Arnold |
| 2,083,217 | A | 6/1937 | Brothers et al. |
| 2,097,987 | A | 11/1937 | Edward |
| 2,111,880 | A | 3/1938 | Waters |
| 2,117,174 | A | 5/1938 | Jones |
| 2,129,082 | A | 9/1938 | Byrer |
| 2,139,245 | A | 12/1938 | Ogden |
| 2,148,483 | A | 2/1939 | Opal et al. |
| 2,161,349 | A | 6/1939 | Hadden |
| 2,164,219 | A | 6/1939 | McGerry |

(56) References Cited

U.S. PATENT DOCUMENTS

| | | | |
|---|---|---|---|
| 2,176,309 | A | 10/1939 | Opal et al. |
| 2,186,005 | A | 1/1940 | Casto |
| 2,196,284 | A | 4/1940 | Ackerman |
| 2,209,173 | A | 7/1940 | Young |
| D122,815 | S | 10/1940 | Crosby |
| 2,218,072 | A | 10/1940 | Runnels |
| 2,225,331 | A | 12/1940 | Campbell |
| 2,233,936 | A | 3/1941 | Campbell |
| 2,244,098 | A | 6/1941 | Busick |
| 2,253,210 | A | 8/1941 | Pshiharis |
| 2,253,910 | A | 8/1941 | Luenz |
| 2,254,365 | A | 9/1941 | Griffith et al. |
| 2,262,982 | A | 11/1941 | Wolcott |
| 2,263,802 | A | 11/1941 | Grusin |
| 2,263,885 | A | 11/1941 | McGauley |
| 2,266,195 | A | 12/1941 | Lay |
| 2,305,461 | A | 12/1942 | Spyra |
| 2,312,828 | A | 3/1943 | Adamsson |
| 2,326,632 | A | 8/1943 | Friedman |
| 2,364,205 | A | 12/1944 | Fuller |
| 2,405,029 | A | 7/1946 | Gallanty et al. |
| 2,418,485 | A | 4/1947 | Shipley |
| 2,438,268 | A | 3/1948 | Bressler |
| 2,443,297 | A | 6/1948 | Bressler |
| 2,491,274 | A | 12/1949 | McNeill |
| 2,512,059 | A | 6/1950 | Haeusser |
| D162,941 | S | 1/1951 | Ehrman |
| 2,543,999 | A | 3/1951 | Voss |
| 2,554,777 | A | 5/1951 | Dangin |
| 2,574,654 | A | 11/1951 | Moore |
| 2,583,750 | A | 1/1952 | Runnels |
| 2,631,320 | A | 3/1953 | Bressler |
| 2,634,722 | A | 4/1953 | Frederick |
| 2,637,870 | A | 5/1953 | Cohen |
| 2,642,604 | A | 6/1953 | Ferrari |
| 2,650,383 | A | 9/1953 | Bressler |
| 2,651,068 | A | 9/1953 | Seko |
| 2,676,350 | A | 4/1954 | Bressler |
| 2,685,703 | A | 8/1954 | Dellenbach |
| 2,686,325 | A | 8/1954 | Silver |
| 2,702,914 | A | 3/1955 | Kittle et al. |
| 2,706,825 | A | 4/1955 | Blakeman |
| 2,708,762 | A | 5/1955 | Kling et al. |
| 2,796,620 | A | 6/1957 | Bressler |
| 2,797,424 | A | 7/1957 | Olson |
| 2,882,544 | A | 4/1959 | Hadidian |
| 3,065,479 | A | 11/1962 | McGee |
| 3,103,027 | A | 9/1963 | Birch |
| 3,103,680 | A | 9/1963 | Krichmar |
| 3,129,449 | A | 4/1964 | Cyzer |
| 3,152,349 | A | 10/1964 | Brennesholtz |
| 3,153,800 | A | 10/1964 | Trotin |
| 3,174,174 | A | 3/1965 | Dengler |
| 3,177,509 | A | 4/1965 | Cyzer |
| 3,181,193 | A | 5/1965 | Nobles et al. |
| 3,185,001 | A | 5/1965 | Viator |
| 3,185,582 | A | 5/1965 | Viator |
| 3,188,672 | A | 6/1965 | Gary |
| 3,195,537 | A | 7/1965 | Blasi |
| 3,196,299 | A | 7/1965 | Herbert |
| 3,230,562 | A | 1/1966 | Birch |
| 3,242,516 | A | 3/1966 | Herman |
| 3,253,292 | A | 5/1966 | Herschensohn |
| 3,254,356 | A | 6/1966 | Yao et al. |
| 3,258,805 | A | 7/1966 | Rossnan |
| 3,316,576 | A | 5/1967 | Urbush |
| 3,320,225 | A | 5/1967 | Bradbury |
| 3,337,893 | A | 8/1967 | Fine et al. |
| 3,398,421 | A | 8/1968 | Rashbaum |
| D213,669 | S | 4/1969 | Miller |
| 3,509,874 | A | 5/1970 | Stillman |
| 3,553,759 | A | 1/1971 | Kramer et al. |
| 3,584,795 | A | 6/1971 | Baird |
| 3,599,916 | A | 8/1971 | Szabo |
| 3,610,043 | A | 10/1971 | Wemyss |
| 3,633,237 | A | 1/1972 | Bagube |
| 3,643,282 | A | 2/1972 | Lechene et al. |
| 3,722,020 | A | 3/1973 | Hills |
| D226,942 | S | 5/1973 | Okuda |
| 3,739,419 | A | 6/1973 | Natman et al. |
| 3,766,590 | A | 10/1973 | Wachtel |
| 3,848,871 | A | 11/1974 | Sweet et al. |
| 3,900,550 | A | 8/1975 | Oliver et al. |
| 4,114,222 | A | 9/1978 | Serediuk |
| 4,121,798 | A | 10/1978 | Schumacher et al. |
| D255,511 | S | 6/1980 | Hill et al. |
| 4,223,417 | A | 9/1980 | Solow |
| 4,240,452 | A | 12/1980 | Jean |
| D258,143 | S | 2/1981 | Flick |
| 4,274,174 | A | 6/1981 | Ertel |
| 4,277,862 | A | 7/1981 | Weideman |
| 4,288,883 | A | 9/1981 | Dolinsky |
| 4,299,208 | A | 11/1981 | Blanc |
| 4,328,604 | A | 5/1982 | Adams |
| 4,356,585 | A | 11/1982 | Protell et al. |
| 4,364,142 | A | 12/1982 | Pangle |
| 4,369,284 | A | 1/1983 | Chen |
| D269,141 | S | 5/1983 | Bugay |
| D272,683 | S | 2/1984 | Stocchi |
| D272,687 | S | 2/1984 | Stocchi |
| D272,689 | S | 2/1984 | Stocchi |
| D272,690 | S | 2/1984 | Stocchi |
| D273,635 | S | 5/1984 | Stocchi |
| 4,455,704 | A | 6/1984 | Williams |
| 4,461,285 | A | 7/1984 | Courtin |
| 4,488,327 | A | 12/1984 | Snider |
| 4,488,328 | A | 12/1984 | Hyman |
| 4,500,939 | A | 2/1985 | Gueret |
| 4,520,526 | A | 6/1985 | Peters |
| 4,535,014 | A | 8/1985 | Wright |
| 4,543,679 | A | 10/1985 | Rosofsky et al. |
| 4,563,381 | A | 1/1986 | Woodland |
| 4,566,145 | A | 1/1986 | Wachtel |
| 4,608,968 | A | 9/1986 | Rosofsky |
| 4,609,171 | A | 9/1986 | Matsui |
| 4,610,043 | A | 9/1986 | Vezjak |
| 4,618,213 | A | 10/1986 | Chen |
| D287,072 | S | 12/1986 | Pfleger |
| 4,628,564 | A | 12/1986 | Youssef |
| 4,654,922 | A | 4/1987 | Chen |
| 4,691,405 | A | 9/1987 | Reed |
| 4,694,844 | A | 9/1987 | Berl et al. |
| 4,712,266 | A | 12/1987 | Yamaki |
| 4,712,267 | A | 12/1987 | Cheng |
| 4,712,304 | A | 12/1987 | Sanelli |
| 4,721,021 | A | 1/1988 | Kusznir |
| D295,695 | S | 5/1988 | Golzari |
| 4,757,570 | A | 7/1988 | Haeusser et al. |
| 4,776,054 | A | 10/1988 | Rauch |
| 4,783,869 | A | 11/1988 | Lee |
| 4,800,608 | A | 1/1989 | Key |
| 4,827,551 | A | 5/1989 | Maser et al. |
| 4,829,621 | A | 5/1989 | Phenegar |
| 4,852,832 | A | 8/1989 | Delaney |
| 4,888,844 | A | 12/1989 | Maggs |
| 4,901,212 | A | 2/1990 | Prickett |
| D309,528 | S | 7/1990 | Valenti |
| 5,001,803 | A | 3/1991 | Discko, Jr. |
| 5,005,246 | A | 4/1991 | Yen-Hui |
| D317,986 | S | 7/1991 | Huang |
| 5,027,796 | A | 7/1991 | Linzey |
| 5,032,082 | A | 7/1991 | Herrera |
| 5,040,260 | A | 8/1991 | Michaels |
| 5,052,071 | A | 10/1991 | Halm |
| 5,054,154 | A | 10/1991 | Schiffer et al. |
| 5,067,061 | A | 11/1991 | Prickett |
| 5,070,567 | A | 12/1991 | Holland |
| 5,114,214 | A | 5/1992 | Barman |
| 5,120,225 | A | 6/1992 | Amit |
| 5,121,894 | A | 6/1992 | Twork, Sr. et al. |
| 5,141,192 | A | 8/1992 | Adams |
| 5,146,645 | A | 9/1992 | Dirksing |
| 5,165,761 | A | 11/1992 | Dirksing |
| 5,176,427 | A | 1/1993 | Weihrauch |

(56) References Cited

U.S. PATENT DOCUMENTS

| | | | |
|---|---|---|---|
| 5,184,368 | A | 2/1993 | Holland |
| D334,288 | S | 3/1993 | Witzig-Jaggi |
| D335,579 | S | 5/1993 | Chuang |
| 5,224,764 | A | 7/1993 | Klinkhammer |
| 5,226,197 | A | 7/1993 | Nack et al. |
| 5,228,466 | A | 7/1993 | Klinkhammer |
| 5,230,118 | A | 7/1993 | Chamma |
| 5,242,235 | A | 9/1993 | Li |
| 5,249,327 | A | 10/1993 | Hing |
| D340,808 | S | 11/1993 | Sherman et al. |
| 5,262,468 | A | 11/1993 | Chen |
| 5,269,038 | A | 12/1993 | Bradley |
| 5,273,425 | A | 12/1993 | Hoagland |
| D345,256 | S | 3/1994 | Khin |
| 5,305,489 | A | 4/1994 | Lage |
| 5,305,492 | A | 4/1994 | Giuliani et al. |
| 5,311,414 | A | 5/1994 | Branham, Sr. |
| 5,323,504 | A | 6/1994 | McCusker |
| D348,986 | S | 7/1994 | Ross |
| 5,325,560 | A | 7/1994 | Pavone et al. |
| 5,336,708 | A | 8/1994 | Chen |
| 5,339,482 | A | 8/1994 | Desimone et al. |
| D350,851 | S | 9/1994 | Spence, Jr. |
| 5,345,560 | A | 9/1994 | Miura et al. |
| 5,351,358 | A | 10/1994 | Larrimore |
| 5,353,460 | A | 10/1994 | Bauman |
| 5,355,546 | A | 10/1994 | Scheier et al. |
| 5,360,026 | A | 11/1994 | Klinkhammer |
| 5,371,915 | A | 12/1994 | Key |
| 5,373,602 | A | 12/1994 | Bang |
| D354,881 | S | 1/1995 | Huff |
| 5,390,984 | A | 2/1995 | Boucherie et al. |
| 5,392,483 | A | 2/1995 | Heinzelman et al. |
| 5,393,796 | A | 2/1995 | Halberstadt et al. |
| 5,396,678 | A | 3/1995 | Bredall et al. |
| 5,398,366 | A | 3/1995 | Bradley |
| 5,398,369 | A | 3/1995 | Heinzelman et al. |
| 5,416,942 | A | 5/1995 | Baldacci et al. |
| D358,938 | S | 6/1995 | Schneider et al. |
| 5,435,032 | A | 7/1995 | McDougall |
| 5,438,726 | A | 8/1995 | Leite |
| 5,445,825 | A | 8/1995 | Copelan et al. |
| 5,454,133 | A | 10/1995 | Garnet |
| 5,465,450 | A | 11/1995 | Humphries |
| 5,481,775 | A | 1/1996 | Gentile et al. |
| 5,483,722 | A | 1/1996 | Scheier et al. |
| 5,491,866 | A | 2/1996 | Simonds |
| D368,163 | S | 3/1996 | Overthun |
| 5,497,526 | A | 3/1996 | Klinkhammer |
| 5,502,930 | A | 4/1996 | Burkette et al. |
| 5,504,959 | A | 4/1996 | Yukawa et al. |
| 5,508,334 | A | 4/1996 | Chen |
| 5,511,273 | A | 4/1996 | Carroll |
| 5,511,275 | A | 4/1996 | Volpenhein et al. |
| 5,511,277 | A | 4/1996 | Simonds |
| 5,524,319 | A | 6/1996 | Avidor |
| 5,528,786 | A | 6/1996 | Porat et al. |
| D371,680 | S | 7/1996 | Juhlin et al. |
| 5,530,981 | A | 7/1996 | Chen |
| 5,535,474 | A | 7/1996 | Salazar |
| 5,546,624 | A | 8/1996 | Bock |
| D375,206 | S | 11/1996 | Halm |
| 5,570,487 | A | 11/1996 | Schneider |
| D376,695 | S | 12/1996 | Tveras |
| 5,581,840 | A | 12/1996 | Chen et al. |
| 5,584,690 | A | 12/1996 | Maassarani |
| 5,604,951 | A | 2/1997 | Shipp |
| 5,607,230 | A | 3/1997 | Protz, Jr. |
| 5,613,262 | A | 3/1997 | Choy-Maldonado |
| 5,618,882 | A | 4/1997 | Hammond et al. |
| 5,625,916 | A | 5/1997 | McDougall |
| 5,628,082 | A | 5/1997 | Moskovich |
| 5,630,244 | A | 5/1997 | Chang |
| 5,633,286 | A | 5/1997 | Chen |
| 5,639,049 | A | 6/1997 | Jennings et al. |
| 5,651,158 | A | 7/1997 | Halm |
| D382,407 | S | 8/1997 | Craft et al. |
| 5,673,452 | A | 10/1997 | Chang et al. |
| 5,673,454 | A | 10/1997 | Quintanilla et al. |
| D386,313 | S | 11/1997 | Moskovich |
| 5,689,850 | A | 11/1997 | Shekalim |
| D386,905 | S | 12/1997 | Brady et al. |
| 5,709,004 | A | 1/1998 | Paduano et al. |
| D390,706 | S | 2/1998 | Hohlbein et al. |
| D391,769 | S | 3/1998 | Kling et al. |
| 5,735,011 | A | 4/1998 | Asher |
| 5,735,012 | A | 4/1998 | Heinzelman et al. |
| 5,735,864 | A | 4/1998 | Heisinger, Jr. |
| 5,742,972 | A | 4/1998 | Bredall et al. |
| 5,758,380 | A | 6/1998 | Vrignaud |
| 5,758,383 | A | 6/1998 | Hohlbein |
| 5,765,252 | A | 6/1998 | Carr |
| 5,766,193 | A | 6/1998 | Millner |
| D396,288 | S | 7/1998 | Samuel |
| 5,774,923 | A | 7/1998 | Halm |
| 5,778,475 | A | 7/1998 | Garcia |
| 5,778,476 | A | 7/1998 | Squillaci et al. |
| 5,779,654 | A | 7/1998 | Foley et al. |
| 5,781,958 | A | 7/1998 | Meessmann et al. |
| D397,219 | S | 8/1998 | Rangel et al. |
| 5,792,159 | A | 8/1998 | Amin |
| 5,799,354 | A | 9/1998 | Amir |
| 5,802,656 | A | 9/1998 | Dawson et al. |
| 5,810,856 | A | 9/1998 | Tveras |
| 5,813,079 | A | 9/1998 | Halm |
| D399,349 | S | 10/1998 | Barth |
| 5,816,687 | A | 10/1998 | Tapp |
| 5,817,114 | A | 10/1998 | Anderson et al. |
| 5,818,856 | A | 10/1998 | Injeyan et al. |
| 5,823,655 | A | 10/1998 | Brooks |
| RE35,941 | E | 11/1998 | Stansbury, Jr. |
| D401,069 | S | 11/1998 | Lamond et al. |
| 5,836,030 | A | 11/1998 | Hazeu et al. |
| 5,836,033 | A | 11/1998 | Berge |
| 5,839,148 | A | 11/1998 | Volpenhein et al. |
| 5,839,149 | A | 11/1998 | Scheier et al. |
| D402,116 | S | 12/1998 | Magloff et al. |
| 5,845,358 | A | 12/1998 | Woloch |
| 5,848,838 | A | 12/1998 | Presta |
| D403,510 | S | 1/1999 | Menke et al. |
| D404,205 | S | 1/1999 | Hohlbein |
| D404,206 | S | 1/1999 | Hohlbein |
| 5,860,183 | A | 1/1999 | Kam |
| D405,272 | S | 2/1999 | Khalaj et al. |
| D407,221 | S | 3/1999 | Van Gelder |
| D407,222 | S | 3/1999 | Van Gelder |
| D407,223 | S | 3/1999 | Van Gelder |
| 5,875,510 | A | 3/1999 | Lamond et al. |
| 5,896,614 | A | 4/1999 | Flewitt |
| 5,908,038 | A | 6/1999 | Bennett |
| 5,913,346 | A | 6/1999 | Narwani |
| 5,915,433 | A | 6/1999 | Hybler |
| D412,064 | S | 7/1999 | Achepohl et al. |
| 5,920,941 | A | 7/1999 | Iannotta |
| 5,926,901 | A | 7/1999 | Tseng et al. |
| 5,928,254 | A | 7/1999 | Jensen |
| 5,930,860 | A | 8/1999 | Shipp |
| 5,938,673 | A | 8/1999 | DePierro et al. |
| D413,728 | S | 9/1999 | Waguespack et al. |
| 5,946,758 | A | 9/1999 | Hohlbein et al. |
| 5,946,759 | A | 9/1999 | Cann |
| 5,951,578 | A | 9/1999 | Jensen |
| 5,956,797 | A | 9/1999 | Wilson |
| 5,957,942 | A | 9/1999 | Yudelman |
| D415,352 | S | 10/1999 | Beals et al. |
| 5,964,009 | A | 10/1999 | Hoepfl et al. |
| 5,967,152 | A | 10/1999 | Rimkus |
| 5,970,564 | A | 10/1999 | Inns et al. |
| D416,685 | S | 11/1999 | Overthun |
| 5,974,614 | A | 11/1999 | Ross |
| 5,980,541 | A | 11/1999 | Tenzer |
| 5,980,542 | A | 11/1999 | Saldivar |
| 5,984,935 | A | 11/1999 | Welt et al. |
| 5,987,688 | A | 11/1999 | Roberts et al. |

(56) References Cited

U.S. PATENT DOCUMENTS

| | | | |
|---|---|---|---|
| 5,987,690 | A | 11/1999 | Heuler |
| 5,991,958 | A | 11/1999 | Hohlbein |
| 5,991,959 | A | 11/1999 | Raven et al. |
| 6,000,083 | A | 12/1999 | Blaustein et al. |
| 6,003,189 | A | 12/1999 | Falleiros |
| 6,004,334 | A | 12/1999 | Mythen |
| 6,006,395 | A | 12/1999 | Tiramani et al. |
| D418,979 | S | 1/2000 | Moskovich et al. |
| D418,981 | S | 1/2000 | Cheong et al. |
| D419,304 | S | 1/2000 | Moskovich et al. |
| 6,015,293 | A | 1/2000 | Rimkus |
| D419,773 | S | 2/2000 | Beals et al. |
| D420,515 | S | 2/2000 | Van Gelder |
| D420,802 | S | 2/2000 | Cheong et al. |
| D420,804 | S | 2/2000 | Juhlin et al. |
| D421,184 | S | 2/2000 | Koh et al. |
| D421,841 | S | 3/2000 | Achepohl et al. |
| D421,843 | S | 3/2000 | Joergensen |
| D421,844 | S | 3/2000 | Stark et al. |
| 6,032,313 | A | 3/2000 | Tsang |
| 6,032,315 | A | 3/2000 | Liebel |
| 6,041,467 | A | 3/2000 | Roberts et al. |
| D422,413 | S | 4/2000 | Goldfinger et al. |
| 6,049,936 | A | 4/2000 | Holley |
| 6,050,709 | A | 4/2000 | Hastings |
| D423,785 | S | 5/2000 | Karallis |
| D423,786 | S | 5/2000 | Zelinski |
| D423,787 | S | 5/2000 | Musciano |
| D424,808 | S | 5/2000 | Beals et al. |
| D424,809 | S | 5/2000 | Bernard |
| D425,306 | S | 5/2000 | Beals et al. |
| 6,058,541 | A | 5/2000 | Masterman et al. |
| 6,066,282 | A | 5/2000 | Kramer |
| 6,070,286 | A | 6/2000 | Cardarelli |
| 6,073,299 | A | 6/2000 | Hohlbein |
| 6,076,223 | A | 6/2000 | Dair et al. |
| D427,437 | S | 7/2000 | Vonarburg |
| 6,088,870 | A | 7/2000 | Hohlbein |
| D428,702 | S | 8/2000 | Van Gelder |
| D429,566 | S | 8/2000 | Yoshimoto et al. |
| D429,567 | S | 8/2000 | Yoshimoto et al. |
| 6,094,769 | A | 8/2000 | Driesen et al. |
| 6,098,233 | A | 8/2000 | Chen |
| 6,101,659 | A | 8/2000 | Halm |
| 6,105,191 | A | 8/2000 | Chen et al. |
| 6,108,849 | A | 8/2000 | Weihrauch |
| 6,108,851 | A | 8/2000 | Bredall et al. |
| 6,108,869 | A | 8/2000 | Meessmann et al. |
| 6,115,870 | A | 9/2000 | Solanki et al. |
| 6,119,296 | A | 9/2000 | Noe et al. |
| 6,128,808 | A | 10/2000 | Jansson et al. |
| 6,131,228 | A | 10/2000 | Chen et al. |
| 6,141,817 | A | 11/2000 | Dawson |
| 6,151,745 | A | 11/2000 | Roberts et al. |
| D434,906 | S | 12/2000 | Beals et al. |
| 6,161,243 | A | 12/2000 | Weihrauch |
| 6,161,245 | A | 12/2000 | Weihrauch |
| 6,171,323 | B1 | 1/2001 | Potti et al. |
| 6,178,582 | B1 | 1/2001 | Halm |
| 6,179,503 | B1 | 1/2001 | Taghavi-Khanghah |
| D437,486 | S | 2/2001 | Francos |
| 6,185,779 | B1 | 2/2001 | Kramer |
| D439,412 | S | 3/2001 | Volpenhein et al. |
| 6,205,611 | B1 | 3/2001 | Vigil |
| D440,767 | S | 4/2001 | Moskovich et al. |
| 6,219,874 | B1 | 4/2001 | van Gelder et al. |
| D441,958 | S | 5/2001 | Rueb |
| 6,230,356 | B1 | 5/2001 | Hyo-Moon |
| 6,237,178 | B1 | 5/2001 | Krammer et al. |
| D443,142 | S | 6/2001 | Harada |
| 6,254,390 | B1 | 7/2001 | Wagner |
| 6,260,227 | B1 | 7/2001 | Fulop |
| 6,266,840 | B1 | 7/2001 | Munro |
| D446,021 | S | 8/2001 | Jen |
| D447,238 | S | 8/2001 | Tang |
| 6,273,719 | B1 | 8/2001 | Whitman |
| 6,276,021 | B1 | 8/2001 | Hohlbein |
| D448,174 | S | 9/2001 | Harris et al. |
| 6,289,545 | B1 | 9/2001 | Molster |
| 6,290,496 | B1 | 9/2001 | Azar et al. |
| D448,569 | S | 10/2001 | Harris et al. |
| D448,570 | S | 10/2001 | Harris et al. |
| D448,571 | S | 10/2001 | Harris et al. |
| 6,298,516 | B1 | 10/2001 | Beals et al. |
| 6,308,358 | B2 | 10/2001 | Gruber et al. |
| D450,457 | S | 11/2001 | Hohlbein |
| D450,928 | S | 11/2001 | Weisbarth |
| 6,311,358 | B1 | 11/2001 | Soetewey et al. |
| 6,311,360 | B1 | 11/2001 | Lanvers |
| 6,314,605 | B1 | 11/2001 | Solanki et al. |
| 6,314,606 | B1 | 11/2001 | Hohlbein |
| 6,319,332 | B1 | 11/2001 | Gavney, Jr. et al. |
| 6,322,362 | B1 | 11/2001 | Holms |
| 6,322,573 | B1 | 11/2001 | Murayama |
| 6,325,626 | B1 | 12/2001 | Blass |
| 6,327,735 | B1 | 12/2001 | Kramer |
| 6,332,233 | B1 | 12/2001 | Proulx |
| D452,615 | S | 1/2002 | Cheong et al. |
| 6,338,176 | B1 | 1/2002 | Smith et al. |
| 6,338,460 | B1 | 1/2002 | Rumpel |
| D453,270 | S | 2/2002 | Choong |
| 6,345,405 | B1 | 2/2002 | Brackin |
| D453,998 | S | 3/2002 | Ping |
| D454,252 | S | 3/2002 | Lee |
| 6,352,545 | B1 | 3/2002 | Wagner |
| 6,353,958 | B2 | 3/2002 | Weihrauch |
| 6,360,395 | B2 | 3/2002 | Blaustein et al. |
| 6,360,398 | B1 | 3/2002 | Wiegner et al. |
| RE37,625 | E | 4/2002 | Wieder et al. |
| D456,139 | S | 4/2002 | Hohlbein |
| 6,374,448 | B2 | 4/2002 | Seifert |
| D456,607 | S | 5/2002 | Carlucci et al. |
| D457,323 | S | 5/2002 | Hohlbein |
| D457,325 | S | 5/2002 | Wilson et al. |
| 6,383,202 | B1 | 5/2002 | Rosenblood |
| D458,453 | S | 6/2002 | Baertschi |
| D459,086 | S | 6/2002 | Belton et al. |
| D459,087 | S | 6/2002 | Pfleger |
| 6,402,768 | B1 | 6/2002 | Liebel |
| 6,408,476 | B1 | 6/2002 | Cann |
| 6,408,524 | B1 | 6/2002 | Lai |
| 6,421,867 | B1 | 7/2002 | Weihrauch |
| D461,313 | S | 8/2002 | Hohlbein |
| D461,959 | S | 8/2002 | Chan et al. |
| 6,440,149 | B1 | 8/2002 | Potti |
| D462,178 | S | 9/2002 | Moskovich et al. |
| D462,527 | S | 9/2002 | Ping |
| D462,528 | S | 9/2002 | Crossman et al. |
| D463,131 | S | 9/2002 | Winter et al. |
| D463,132 | S | 9/2002 | Winter et al. |
| D463,133 | S | 9/2002 | Hohlbein |
| 6,442,786 | B2 | 9/2002 | Halm et al. |
| 6,446,295 | B1 | 9/2002 | Calabrese |
| D463,668 | S | 10/2002 | Yoshimoto et al. |
| D464,796 | S | 10/2002 | Winter et al. |
| 6,463,618 | B1 | 10/2002 | Zimmer |
| 6,463,619 | B2 | 10/2002 | Gavney, Jr. |
| D465,847 | S | 11/2002 | Jacobs |
| D466,302 | S | 12/2002 | Ping |
| D467,430 | S | 12/2002 | Ping |
| 6,494,594 | B1 | 12/2002 | Schroetter |
| 6,496,999 | B1 | 12/2002 | Gleason et al. |
| 6,505,373 | B2 | 1/2003 | Gelder et al. |
| D469,958 | S | 2/2003 | Saindon et al. |
| 6,513,182 | B1 | 2/2003 | Calabrese et al. |
| 6,514,445 | B1 | 2/2003 | Cann et al. |
| D471,276 | S | 3/2003 | Potti |
| D471,362 | S | 3/2003 | Moskovich et al. |
| 6,546,586 | B2 | 4/2003 | Cho |
| 6,553,604 | B1 | 4/2003 | Braun et al. |
| D474,608 | S | 5/2003 | Hohlbein |
| 6,564,416 | B1 | 5/2003 | Claire et al. |
| D475,531 | S | 6/2003 | Klimeck et al. |
| D476,158 | S | 6/2003 | Ling |

(56) References Cited

U.S. PATENT DOCUMENTS

| | | | |
|---|---|---|---|
| 6,571,417 | B1 | 6/2003 | Gavney, Jr. |
| D476,487 | S | 7/2003 | Saindon et al. |
| D477,465 | S | 7/2003 | Reilly et al. |
| 6,599,048 | B2 | 7/2003 | Kuo |
| D478,211 | S | 8/2003 | Ping |
| D478,213 | S | 8/2003 | Ping |
| D478,424 | S | 8/2003 | Saindon et al. |
| D478,425 | S | 8/2003 | Ping |
| D478,727 | S | 8/2003 | Wong |
| D478,728 | S | 8/2003 | Wong |
| 6,601,272 | B2 | 8/2003 | Stvartak et al. |
| D479,046 | S | 9/2003 | Winkler |
| D479,047 | S | 9/2003 | Wong |
| D479,914 | S | 9/2003 | Choong |
| 6,625,839 | B2 | 9/2003 | Fischer |
| D480,213 | S | 10/2003 | Ping |
| D480,214 | S | 10/2003 | Kling et al. |
| D480,877 | S | 10/2003 | Crossman et al. |
| D482,199 | S | 11/2003 | DeSalvo |
| 6,641,764 | B2 | 11/2003 | Lanvers |
| 6,647,581 | B1 | 11/2003 | Persad et al. |
| D483,183 | S | 12/2003 | De Salvo |
| D483,184 | S | 12/2003 | Geiberger et al. |
| D483,568 | S | 12/2003 | Jamson |
| D483,569 | S | 12/2003 | Wong |
| 6,654,979 | B2 | 12/2003 | Calabrese |
| 6,675,428 | B2 | 1/2004 | Halm |
| D485,989 | S | 2/2004 | Winkler |
| D486,649 | S | 2/2004 | Sprosta et al. |
| 6,687,940 | B1 | 2/2004 | Gross et al. |
| D487,195 | S | 3/2004 | Winkler |
| 6,708,364 | B1 | 3/2004 | Huber |
| D488,621 | S | 4/2004 | Wong |
| 6,729,789 | B2 | 5/2004 | Gordon |
| 6,735,804 | B2 | 5/2004 | Carlucci et al. |
| 6,747,581 | B2 | 6/2004 | Hodges |
| 6,779,851 | B2 | 8/2004 | Bouchiere |
| 6,792,642 | B2 | 9/2004 | Wagstaff |
| 6,799,346 | B2 | 10/2004 | Jeng et al. |
| 6,802,097 | B2 | 10/2004 | Hafliger et al. |
| 6,817,054 | B2 | 11/2004 | Moskovich et al. |
| 6,820,299 | B2 | 11/2004 | Gavney, Jr. |
| D501,084 | S | 1/2005 | Schaefer et al. |
| 6,859,969 | B2 | 3/2005 | Gavney et al. |
| 6,865,767 | B1 | 3/2005 | Gavney, Jr. |
| D503,538 | S | 4/2005 | DeSalvo |
| 6,886,207 | B1 | 5/2005 | Solanki |
| 6,895,629 | B1 | 5/2005 | Wenzler |
| 6,931,688 | B2 | 8/2005 | Moskovich et al. |
| 6,938,294 | B2 | 9/2005 | Fattori et al. |
| 6,988,777 | B2 | 1/2006 | Pfenniger et al. |
| D517,812 | S | 3/2006 | Hohlbein et al. |
| 7,020,928 | B2 | 4/2006 | Hohlbein |
| 7,036,179 | B1 | 5/2006 | Weihrauch |
| 7,047,591 | B2 | 5/2006 | Hohlbein |
| 7,143,462 | B2 | 12/2006 | Hohlbein |
| 7,162,767 | B2 | 1/2007 | Pfenniger et al. |
| 7,360,270 | B2 | 4/2008 | Moskovich et al. |
| 7,607,189 | B2 | 10/2009 | Moskovich |
| 7,614,111 | B2 | 11/2009 | Moskovich et al. |
| 7,703,163 | B2 | 4/2010 | Jimenez et al. |
| 7,721,376 | B2 | 5/2010 | Hohlbein et al. |
| 7,725,981 | B2 | 6/2010 | Moskovich et al. |
| 7,757,326 | B2 | 7/2010 | Jimenez et al. |
| 7,841,041 | B2 | 11/2010 | Moskovich et al. |
| 7,845,042 | B2 | 12/2010 | Moskovich et al. |
| 7,962,991 | B2 | 6/2011 | Hohlbein |
| 8,393,042 | B2 | 3/2013 | Moskovich et al. |
| 2001/0001334 | A1 | 5/2001 | Gruber et al. |
| 2001/0013151 | A1 | 8/2001 | Gelder et al. |
| 2001/0014232 | A1 | 8/2001 | Suda et al. |
| 2001/0023516 | A1 | 9/2001 | Driesen et al. |
| 2001/0041903 | A1 | 11/2001 | Richard |
| 2001/0042280 | A1 | 11/2001 | Moskovich et al. |
| 2001/0047556 | A1 | 12/2001 | Weihrauch |
| 2002/0004964 | A1 | 1/2002 | Luchino et al. |
| 2002/0015612 | A1 | 2/2002 | Aoyama |
| 2002/0019645 | A1 | 2/2002 | Fischer et al. |
| 2002/0100134 | A1 | 8/2002 | Dunn et al. |
| 2002/0108194 | A1 | 8/2002 | Carlucci et al. |
| 2002/0120991 | A1 | 9/2002 | Cacka et al. |
| 2002/0124333 | A1 | 9/2002 | Haflinger et al. |
| 2002/0124337 | A1 | 9/2002 | Calabrese et al. |
| 2002/0138926 | A1 | 10/2002 | Brown, Jr. et al. |
| 2002/0138928 | A1 | 10/2002 | Calabrese |
| 2002/0138931 | A1 | 10/2002 | Davies |
| 2002/0170145 | A1 | 11/2002 | Stvartak et al. |
| 2003/0009837 | A1 | 1/2003 | Cann |
| 2003/0033679 | A1 | 2/2003 | Fattori et al. |
| 2003/0066145 | A1 | 4/2003 | Prineppi |
| 2003/0077107 | A1 | 4/2003 | Kuo |
| 2003/0084525 | A1 | 5/2003 | Blaustein et al. |
| 2003/0115699 | A1 | 6/2003 | Wagstaff |
| 2003/0115705 | A1 | 6/2003 | Aoyama |
| 2003/0116884 | A1 | 6/2003 | Wagstaff |
| 2003/0159224 | A1 | 8/2003 | Fischer et al. |
| 2003/0163149 | A1 | 8/2003 | Heisinger et al. |
| 2003/0167582 | A1 | 9/2003 | Fischer et al. |
| 2003/0182744 | A1 | 10/2003 | Fattori |
| 2003/0196283 | A1 | 10/2003 | Eliav et al. |
| 2003/0208865 | A1 | 11/2003 | Davies |
| 2003/0216762 | A1 | 11/2003 | Levit |
| 2003/0229959 | A1 | 12/2003 | Gavney et al. |
| 2004/0006837 | A1 | 1/2004 | Cann |
| 2004/0010876 | A1 | 1/2004 | Kraemer |
| 2004/0025272 | A1 | 2/2004 | Stvartak et al. |
| 2004/0025274 | A1 | 2/2004 | Moskovich |
| 2004/0025275 | A1 | 2/2004 | Moskovich et al. |
| 2004/0026272 | A1 | 2/2004 | Conti et al. |
| 2004/0031115 | A1 | 2/2004 | Gavney et al. |
| 2004/0060137 | A1 | 4/2004 | Eliav |
| 2004/0068810 | A1 | 4/2004 | Lee |
| 2004/0117934 | A1 | 6/2004 | Pfenniger et al. |
| 2004/0134007 | A1 | 7/2004 | Davies |
| 2004/0168269 | A1 | 9/2004 | Kunita et al. |
| 2004/0177462 | A1 | 9/2004 | Brown, Jr. et al. |
| 2004/0200016 | A1 | 10/2004 | Chan et al. |
| 2004/0200748 | A1 | 10/2004 | Klassen et al. |
| 2004/0221409 | A1 | 11/2004 | Gavney, Jr. |
| 2004/0231076 | A1 | 11/2004 | Gavney, Jr. |
| 2004/0237236 | A1 | 12/2004 | Gavney, Jr. |
| 2004/0255416 | A1 | 12/2004 | Hohlbein |
| 2005/0000043 | A1 | 1/2005 | Chan et al. |
| 2005/0000049 | A1 | 1/2005 | Hohlbein |
| 2005/0015904 | A1 | 1/2005 | Gavney, Jr. |
| 2005/0038461 | A1 | 2/2005 | Phillips |
| 2005/0069372 | A1 | 3/2005 | Hohlbein et al. |
| 2005/0188487 | A1 | 9/2005 | Moskovich et al. |
| 2005/0188489 | A1 | 9/2005 | Hohlbein |
| 2006/0026784 | A1 | 2/2006 | Moskovich |
| 2006/0064833 | A1 | 3/2006 | Jacobs |
| 2006/0200925 | A1 | 9/2006 | Moskovich et al. |
| 2007/0277339 | A1 | 12/2007 | Barsheshet |
| 2008/0315668 | A1 | 12/2008 | Huber et al. |

FOREIGN PATENT DOCUMENTS

| | | | |
|---|---|---|---|
| CH | 460 705 | | 10/1968 |
| CN | 2235227 | Y | 9/1996 |
| CN | 1150748 | | 5/1997 |
| CN | 1207655 | | 2/1999 |
| CN | 2357572 | | 1/2000 |
| CN | 1406119 | | 3/2003 |
| CN | 2607847 | | 3/2004 |
| CN | 101296634 | A | 10/2008 |
| DE | 587128 | | 11/1952 |
| DE | 857128 | | 11/1952 |
| DE | 1657299 | | 5/1967 |
| DE | 2930459 | | 2/1981 |
| DE | 3114507 | | 3/1983 |
| DE | 3228679 | | 2/1984 |
| DE | 3639424 | | 6/1988 |
| DE | 3840136 | | 5/1990 |
| DE | 4122524 | | 2/1992 |

(56) References Cited

FOREIGN PATENT DOCUMENTS

| | | |
|---|---|---|
| DE | 9319232 | 3/1994 |
| DE | 9416395 | 12/1994 |
| DE | 4412301 | 10/1995 |
| DE | 29821121 | 3/1999 |
| DE | 29822826 | 4/1999 |
| DE | 19817704 | 10/1999 |
| DE | 19949671 | 4/2001 |
| DE | 20107614 | 9/2002 |
| DE | 20109123 | 10/2002 |
| DE | 10122987 | 11/2002 |
| DE | 10258519 | 7/2004 |
| DE | 202005009026 | 10/2005 |
| EP | 0336641 | 10/1989 |
| EP | 0360766 | 3/1990 |
| EP | 0371293 | 6/1990 |
| EP | 0454625 | 10/1991 |
| EP | 0460610 | 12/1991 |
| EP | 0613636 | 9/1994 |
| EP | 0648448 | 4/1995 |
| EP | 0875169 | 11/1998 |
| EP | 0930030 | 7/1999 |
| EP | 1034721 | 9/2000 |
| EP | EP 1308108 | 9/2000 |
| EP | 1059049 | 12/2000 |
| EP | 1350442 | 3/2003 |
| EP | 1486137 | 12/2004 |
| FR | 537979 | 6/1922 |
| FR | 38440 | 6/1931 |
| FR | 707727 | 7/1931 |
| FR | 777340 | 2/1935 |
| FR | 2594307 | 8/1987 |
| FR | 2652245 | 3/1991 |
| GB | 17643 | 0/1912 |
| GB | 191117643 | 0/1912 |
| GB | 189335 | 11/1922 |
| GB | 304459 | 1/1929 |
| GB | 421414 | 6/1934 |
| GB | 480845 | 3/1938 |
| GB | 495982 | 11/1938 |
| GB | 524135 | 7/1940 |
| GB | 647924 | 12/1950 |
| GB | 1330606 | 9/1973 |
| GB | 2371217 | 7/2002 |
| GB | 2391462 | 2/2004 |
| JP | 1-214306 | 8/1989 |
| JP | 1214306 | 8/1989 |
| JP | 5076416 | 3/1993 |
| JP | 8-322641 | 12/1996 |
| JP | 8322641 | 12/1996 |
| JP | 2000-000118 | 1/2000 |
| JP | 2002-010832 | 1/2002 |
| JP | 2002-142867 | 5/2002 |
| JP | 2002-191436 | 7/2002 |
| JP | 2002-223853 | 8/2002 |
| MX | PA02006372 A | 11/2002 |
| NL | 45152 | 2/1939 |
| RU | 2039518 | 7/1995 |
| RU | 2048132 | 11/1995 |
| RU | 2239342 | 11/2004 |
| SU | 1687243 | 10/1991 |
| SU | 1708283 | 1/1992 |
| WO | WO 89/06528 | 7/1989 |
| WO | WO 90/01281 | 2/1990 |
| WO | WO 92/17092 | 10/1992 |
| WO | WO 92/17093 | 10/1992 |
| WO | WO 94/05183 | 3/1994 |
| WO | WO 94/09678 | 5/1994 |
| WO | WO 96/02165 | 2/1996 |
| WO | WO 96/15696 | 5/1996 |
| WO | WO 97/25899 | 7/1997 |
| WO | WO 97/25900 | 7/1997 |
| WO | WO 98/05241 | 2/1998 |
| WO | WO 98/07349 | 2/1998 |
| WO | WO 98/09573 | 3/1998 |
| WO | WO 98/98458 | 3/1998 |
| WO | WO 98/18364 | 5/1998 |
| WO | WO 98/25500 | 6/1998 |
| WO | WO 99/03718 | 7/1999 |
| WO | WO 99/49754 | 10/1999 |
| WO | WO 00/49911 | 8/2000 |
| WO | WO 00/53054 | 9/2000 |
| WO | WO 00/64306 | 11/2000 |
| WO | WO 00/64307 | 11/2000 |
| WO | WO 00/76369 | 12/2000 |
| WO | WO 01/17433 | 3/2001 |
| WO | WO 01/45573 | 6/2001 |
| WO | WO 01/80686 | 11/2001 |
| WO | WO 01/91603 | 12/2001 |
| WO | WO 02/062174 | 8/2002 |
| WO | WO 02/071967 | 9/2002 |
| WO | WO 02/087464 | 11/2002 |
| WO | WO 03/005855 | 1/2003 |
| WO | WO 03/020159 | 3/2003 |
| WO | WO 03/030680 | 4/2003 |
| WO | WO 03/037210 | 5/2003 |
| WO | WO 03/043459 | 5/2003 |
| WO | WO 03/090639 | 11/2003 |
| WO | WO2004/014181 | 2/2004 |
| WO | WO 2004/014182 | 2/2004 |
| WO | WO 2004/019801 | 3/2004 |
| WO | WO 2004/026162 | 4/2004 |
| WO | WO 2004/028235 | 4/2004 |
| WO | WO 2004/082428 | 9/2004 |
| WO | WO 2005/084486 | 9/2005 |
| WO | WO 2006/005216 | 1/2006 |
| WO | WO 2007/051099 | 5/2007 |

OTHER PUBLICATIONS

Computer generated English translation of JP 2002-10832, Suzuki, Jan. 2002.

Computer generated English Translation of JP 2002-142867, published May 21, 2002.

Decision on Grant from the Patent Office of Russia from corresponding Russian Patent Application No. 2008148126 [English translation].

DELFT, 1986, "Construeren in Kunststoffen Deel B".

English translation of Abstract of JP 2002-10832, Suzuki, Jan. 2002.

Himont USA Inc., 1989, "Guide for Injection Molding," Pro-fax Polyproplyene.

International Search Report and Written Opinion in International Application No. PCT/US08/078223, mailed Jul. 2, 2009.

Spencer Chemical Co., 1963, "The Integral Hinge," "Poly-Pro," Polyproplyene.

ORAL CARE IMPLEMENT

CROSS-REFERENCE TO RELATED PATENT APPLICATIONS

This application is a continuation of U.S. patent application Ser. No. 13/162,915, filed Jun. 17, 2011, which is a continuation of U.S. patent application Ser. No. 12/751,109, filed Mar. 31, 2010, now U.S. Pat. No. 7,975,346, which is a continuation of U.S. patent application Ser. No. 11/429,677, filed May 8, 2006, now U.S. Pat. No. 7,841,041, which is a continuation in part of U.S. patent application Ser. No. 11/256,790, filed Oct. 24, 2005, now U.S. Pat. No. 7,614,111, which is a continuation in part of U.S. patent application Ser. No. 11/122,224, filed May 5, 2005, which is a continuation in part of U.S. patent application Ser. No. 10/768,363, filed Jan. 30, 2004, which is a continuation in part of U.S. patent application Ser. No. 10/697,213, filed Oct. 30, 2003.

Further, U.S. patent application Ser. No. 11/429,677, filed May 8, 2006, is a continuation in part of U.S. patent application Ser. No. 11/019,671, filed Dec. 23, 2004, which is: (1) a continuation in part of U.S. patent application Ser. No. 10/869,922, filed Jun. 18, 2004, which is a continuation in part of U.S. patent application Ser. No. 10/601,106, filed Jun. 20, 2003; (2) a continuation in part of International Patent Application Serial No. PCT/US03/030633 filed Sep. 26, 2003, which claims the benefit of U.S. Provisional Patent Application Ser. No. 60/414,117, filed Sep. 27, 2002, U.S. Provisional Patent Application Ser. No. 60/418,776, filed Oct. 16, 2002, and U.S. Provisional Patent Application Ser. No. 60/419,425, filed Oct. 18, 2002; (3) a continuation in part of International Patent Application Serial No. PCT/US2003/029497, filed Sep. 17, 2003, which claims the benefit of U.S. Provisional Patent Application Ser. No. 60/412,290, filed Sep. 20, 2002; (4) a continuation in part of U.S. Design patent application Ser. No. 29/189,729, filed Sep. 10, 2003; and (5) a continuation-in-part of U.S. patent application Ser. No. 10/989,267, filed Nov. 17, 2004, which is a continuation-in-part of U.S. Design patent application Ser. No. 29/209,242, filed Jul. 14, 2004.

Additionally, U.S. patent application Ser. No. 11/429,677, filed May 8, 2006, is a continuation in part of U.S. patent application Ser. No. 10/989,267, filed Nov. 17, 2004, which is a continuation in part of U.S. Design patent application Ser. No. 29/209,242, filed Jul. 14, 2004, and a continuation in part of U.S. Design patent application Ser. No. 29/209,244, filed Jul. 14, 2004.

Further, U.S. patent application Ser. No. 11/429,677, filed May 8, 2006, is a continuation in part of U.S. patent application Ser. No. 10/902,257, filed Jul. 30, 2004, which is: (1) a continuation in part of International Patent Application Serial No. PCT/US2003/029497, filed Sep. 17, 2003, which claims the benefit of U.S. Provisional Patent Application Ser. No. 60/412,290, filed Sep. 20, 2002; and (2) a continuation in part of U.S. Design patent application Ser. No. 29/189,729, filed Sep. 10, 2003.

In addition, U.S. patent application Ser. No. 11/429,677, filed May 8, 2006, is a continuation in part of U.S. patent application Ser. No. 11/053,583, filed Feb. 8, 2005, which is a continuation of International Patent Application Serial No. PCT/US2003/024878, filed Aug. 8, 2003, which claims the benefit of U.S. Provisional Patent Application Ser. No. 60/402,162 filed Aug. 9, 2002, No. 60/402,170, filed Aug. 9, 2002 and U.S. Provisional Patent Application Ser. No. 60/402,670 filed Aug. 12, 2002.

Further, U.S. patent application Ser. No. 11/429,677, filed May 8, 2006, is a continuation in part of U.S. patent application Ser. No. 11/053,589, filed Feb. 8, 2005, which is a continuation of International Patent Application Serial No. PCT/US2003/024879, filed Aug. 8, 2003, which claims the benefit of U.S. Provisional Patent Application Ser. No. 60/402,165 filed, Aug. 9, 2002.

The contents of the above-noted applications are each expressly incorporated herein by reference.

FIELD OF THE INVENTION

The present invention relates generally to oral care implements, and specifically to oral care implements, such as toothbrushes, that include movable cleaning features.

BACKGROUND OF THE INVENTION

A variety of toothbrush configurations exist that have stationary and/or mechanically-driven movable cleaning elements. These conventional toothbrushes are dedicated to tooth cleaning/polishing operations and typically include a head portion directed to the cleaning/polishing operations, and a handle portion. The head typically has a flat or slightly altered surface to which the cleaning elements are attached, or to which mechanically-driven movable carriers for the cleaning elements are attached.

Tongue scrapers exist as devices for removing micro debris disposed on a user's tongue. Conventional tongue scrapers are stand-alone devices directed to the singular purpose of scraping a user's tongue. These conventional devices typically include a handle and scraper portion without including other cleaning elements.

Users manipulate conventional toothbrushes and tongue scrapers by grasping their handle portions. The handles are typically simple, linear rods of a relatively rigid material, which are neither comfortable for the user nor given to easy manipulation. As these devices are commonly used in wet conditions, their handles are often slippery during use.

Many people use multiple oral care implements, such as toothbrushes and tongue scrapers, on a daily basis to accomplish multiple oral care tasks. For instance, a user may use a toothbrush to clean his teeth and then use a tongue scraper to remove debris from his tongue. The user may then re-use the toothbrush to further clean his tongue. Thus, the user may switch between various oral care implements during a single session in a wet environment.

Conventional toothbrushes have cleaning elements that extend from a rigid head. Teeth and gums by nature have a complex intricate contour. Due to the rigid nature of the attachment of the cleaning elements to the head of the toothbrush, the orientation of the cleaning elements is not flexible and thus conventional toothbrushes do not provide optimal cleaning of teeth and gums. Conventional toothbrushes therefore have great difficulty in contacting areas of the teeth located at a greater distance from the head, including interproximal spaces between teeth.

SUMMARY OF THE INVENTION

The present invention pertains to an oral care implement that provides several advantages and that may be used for multiple functions. In one embodiment of the invention, an oral care implement is provided that has a plurality of cleaning elements extending from the head, which are attached to a support that is flexibly attached to the head. The cleaning elements may include forward angled cleaning elements and/ or rearward angled cleaning elements. The cleaning elements may further include a central support at a central portion of the support.

Embodiments of the invention may be multi-functional and include various combinations of features in advantageous combinations. Some embodiments include a soft tissue cleaner in combination with tooth cleaning features and/or in combination with gripping features on the handle that improve the user's grip and handling thereof. The embodiments may be manual or mechanically-driven devices, or combinations thereof.

In one aspect, the invention can be an oral care implement comprising: a handle; a head coupled to the handle, the head having a longitudinal axis and a base structure with a front surface; a cleaning element carrier supported above the front surface of the base structure so that a gap exists between the cleaning element carrier and the base structure, the cleaning element carrier comprising a first longitudinal segment and a second longitudinal segment that are spaced apart by a longitudinal gap; a plurality of first cleaning elements extending from a top surface of the cleaning element carrier; at least one second cleaning element extending from the front surface of the base structure; and wherein an axis that is transverse to the longitudinal axis of the head intersects both the second cleaning element and the cleaning element carrier.

In another aspect, the invention can be an oral care implement comprising: a handle; a head coupled to the handle, the head having a longitudinal axis and a base structure with a front surface; a cleaning element carrier having a top surface and a bottom surface, the cleaning element carrier supported above the front surface of the base structure so that a gap exists between the bottom surface of the cleaning element carrier and the front surface of the base structure; a plurality of first cleaning elements extending from the top surface of the cleaning element carrier; at least one second cleaning element extending from the front surface of the base structure beyond the top surface of the cleaning element carrier; and wherein the second cleaning element and the cleaning element carrier are in transverse alignment.

In yet another aspect, the invention can be an oral care implement comprising: a handle; a head coupled to the handle, the head having a longitudinal axis and a base structure with a front surface; a cleaning element carrier supported above the front surface of the base structure so that a gap exists between a bottom surface of the cleaning element carrier and the front surface of the base structure, the cleaning element carrier comprising a first longitudinal segment and a second longitudinal segment that are at least partially spaced apart along the longitudinal axis of the head by a longitudinal gap; a plurality of first cleaning elements extending from a top surface of the cleaning element carrier; and at least one second cleaning element extending from the front surface of the base structure.

BRIEF DESCRIPTION OF THE DRAWINGS

A more complete understanding of the present invention and the advantages thereof may be acquired by referring to the following description in consideration of the accompanying drawings, in which like reference numbers indicate like features.

DETAILED DESCRIPTION OF THE DRAWINGS

Figure 1:
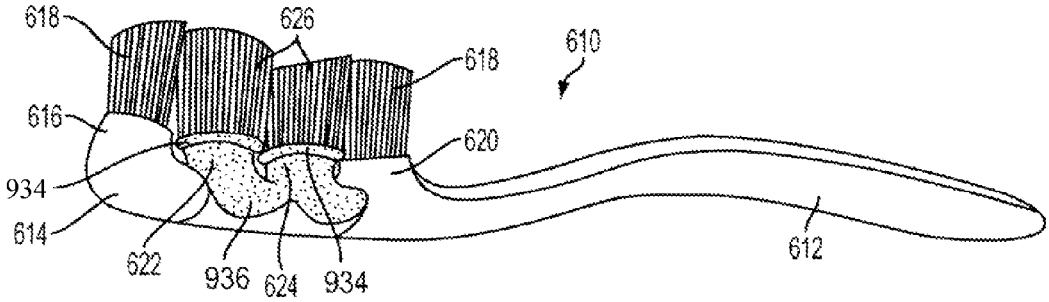
FIG. 1 is a perspective view of an embodiment of an oral care implement such as a toothbrush in accordance with this invention.

The following embodiments describe aspects of the invention in the form of various oral care implement configurations that provide a variety of features and functions. Although these aspects are disclosed in the context of particular exemplary embodiments, the invention provides an oral care implement that includes one or more of the features described herein. The oral care implement may include a first feature described in one example configuration herein, as well as a second feature described in another example configuration herein.

In other words, the invention contemplates mixing and matching features from the disclosed embodiments in various combinations into a single oral care implement. The present invention thus makes it possible to select a combination of cleaning element configurations, tissue cleaner configurations, handle features, gripping features, mechanical driving features, materials and orientations, etc. to achieve intended results, and to deliver additional oral health benefits, such as enhanced cleaning, tooth polishing, tooth whitening, tongue cleaning, massaging of gums, etc.

The term "cleaning elements" is intended to be used in a generic sense which could include elements for cleaning, treating, polishing, whitening, scraping, scrubbing, etc. Cleaning elements may include, but are not limited to, nylon or fiber bristles, massage elements, and elastomeric fingers or walls arranged in a circular cross-sectional shape or any type of desired shape including straight portions or sinusoidal portions. In the form of bristles, the cleaning elements may be secured to a flexible membrane or web via in-molded technology, mounting the tuft blocks or sections by extending them through suitable openings in the flexible membrane, or other mechanisms.

A variety of oral care implement configurations are disclosed herein. One configuration is an oral care implement having multiple groupings of cleaning elements that are uniquely mounted to the head of the oral care implement to facilitate flexible orientation of some groupings relative to the teeth and gums being cleaned. For example, groupings of the head may cooperate to "wrap around" individual teeth resulting in deeper penetration of cleaning/treating elements between teeth. Such configurations can provide effective overall cleaning, for example, by independent movement of groups of cleaning elements relative to the head and each other. This configuration and others are described below.

FIGS. 1-4 illustrate a toothbrush 610 in accordance with one embodiment of this invention. As shown therein toothbrush 610 includes an elongated handle 612 with a head 614 connected to and extending from the handle. The head 614 is divided into a plurality of separate cleaning areas which are spaced from each other. As illustrated the cleaning areas include a base 616 located at the distal end of the head 614 and projecting outwardly from the main body portion 930 (FIG. 4) of the head. Base 616 includes at least one and preferably a plurality of cleaning elements 618. Head 614 further includes a base or supporting member 620 at the proximal end of head 614. Cleaning elements 618 also extend outwardly from base 620.

Mounted between the cleaning areas that incorporate bases 616 and 620 are a pair of pods 622, 624. Each pod is provided with at least one and preferably a plurality of cleaning elements 626. As later described the pods 622, 624 have greater degrees of freedom than do the bases 616, 620. In a preferred practice of the invention the pods 622, 624 are resilient members so that the pod cleaning elements 626 add a motion range beyond the cleaning elements 618 which are generally static or non-movable. Because the various cleaning elements 618, 626 are separated from each other such as by channels 728, which extend completely across head 614 in a transverse direction, and because of the elastic nature of pods 622, 624, the cleaning elements 626 may be capable of 360 degrees rotation about the vertical axis of each individual pod. The angle of the bend may be dictated by the ability of the material to bend.

Toothbrush 610 thus provides a head 614 wherein the front (distal end) and the back (proximal end) areas are in a relatively fixed position and wherein the cleaning/treating elements, such as cleaning elements or bristle strands, 618 do not have any extra degree of motion. The middle portion of head 614, however, has two areas of cleaning elements 626, which are capable of 360 degree rotation.

Figure 4:
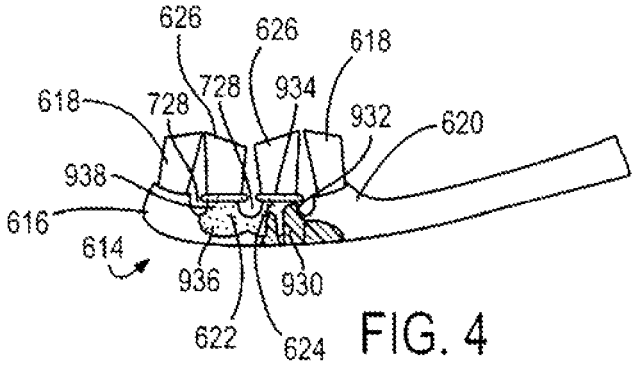
FIG. 4 is a side elevational view similar to FIG. 2 shown partially broken away.

As shown in FIG. 4, the head 614 includes a main body portion 930 which supports the bases and pods. Body portion 930 and bases 616 and 620 are preferably made from conventional hard plastic materials, such as polypropylene for example, commonly used in the making of toothbrush handles and heads. Pods 622, 624, however, are made so as to be resilient. In a preferred practice of this invention, the resiliency of pods 622, 624 is achieved by providing a thin diameter beam 932 which extends from the main body portion 930 of the head of the toothbrush. Beam 932 is joined into the bottom of a thin pad or plate 934 which provides a support area onto which the cleaning elements 626 are affixed. The manner of mounting the cleaning elements 626 to the support pads 934 can be achieved utilizing various cleaning elements, such as bristles and other cleaning materials, in known attachment methods.

The desired flexibility or resiliency of the pods 622, 624 is enhanced by enclosing the thin beams 932 in elastic material 936 during a multi-injection molding process. The elastic material 936 is resilient such that the beams 932 return toward their original form or initial position once a brushing stroke force is removed or reduced. This return action creates an active motion in the opposite direction of the beam bend which aids in the cleaning of teeth by introducing extra brushing strokes.

Figure 2:
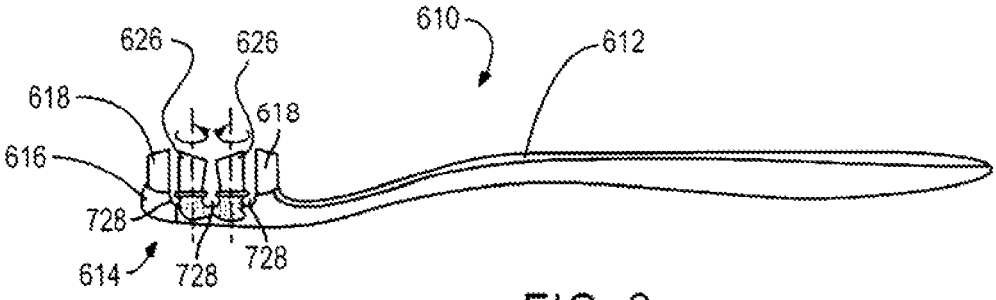
FIG. 2 is a side elevational view, in partial section, of the toothbrush shown in FIG. 1.

As best shown in FIGS. 1, 2 and 4 the pods 622, 624 include a widened portion disposed toward the body 930. The support pads 934 are also widened. Each pod has a narrow or reduced diameter central portion 938 longitudinally intermediate the length of each pod. Thus, each pod is of generally mushroom shape.

Beam 932 could be of any suitable shape such as having a cross-section which is circular, square or any other geometric shape that provides a thin dimension or thin diameter to the beam to facilitate the bendability of the beam. The elastomer 936 may be considered as a continuous layer of any suitable thickness which covers the entire central area of head 614 as illustrated so that both pods 622, 624 are incorporated as part of the same elastic material. The portion of the head 614 which includes pods 622, 624 may be formed as a separate subassembly similar to the subassembly later described with respect to FIGS. 5 and 6.

Although the invention could be practiced with a single base and a single pod and could be practiced with the base having some, but a lesser degree of flexibility than the pod, the invention is preferably practiced wherein the base is generally static or non-movable. In addition, the invention is preferably practiced where there are a plurality of such bases and a plurality of pods. The drawings illustrate a configuration of the invention where there are a total of four separate cleaning areas with the pods being located in the central portion of head 614. The invention may be practiced in a configuration in which the cleaning elements comprise a plurality of bristles or strands on each base and each pod.

Figure 3:
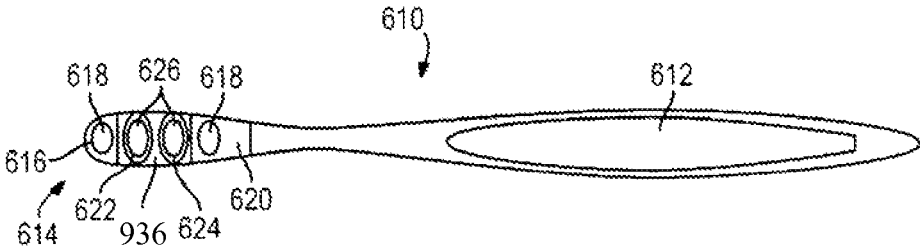
FIG. 3 is a top, plan view of the toothbrush shown in FIGS. 1 and 2.

As illustrated in FIGS. 3 and 4 each base 616 and 620 and each pod 622 and 624 may have a generally oval outer surface. The bases and pods are longitudinally aligned, but spaced from each other by the depressions or open areas which form the channels 728. As also illustrated in FIG. 3 the pods may have a larger outer surface or cleaning element carrying surface than do the bases.

As shown in FIGS. 2 and 4, the terminal surfaces of the cleaning elements 618 and 626 are tapered so that the terminal surfaces of the cleaning elements 618 taper outwardly in a direction toward the center of head 614 while the terminal surfaces of cleaning elements 626 taper outwardly in a direction away from the center of head 614. Thus, the highest points of each set of cleaning elements 618 and its adjacent set of cleaning elements 626 are generally disposed toward each other for each pair of base and pod 616, 622 and 620, 624.

Any suitable form of cleaning elements may be used as the cleaning elements 618 and 626 in the broad practice of this invention. The term "cleaning elements" is intended to be used in a generic sense as described above. Using different cleaning materials as cleaning elements of the toothbrushes may yield different effects. In an attempt to provide better stain removal, a rubber-like material or elastomer can be used in combination with conventional bristles or used by itself to "brighten/whiten" the teeth.

It is to be understood that the specific illustration of the cleaning elements is merely for exemplary purposes. The invention can be practiced with various combinations of the same or different cleaning element configurations (such as stapled, anchor-free tufted (AFT) bristles or in-molded technology (IMT) bristles, etc.) and/or with the same bristle or cleaning elements materials (such as nylon bristles, spiral bristles, rubber bristles, etc.) Similarly, while FIG. 2 illustrates the cleaning elements to be generally perpendicular to the outer surface of head 614, some or all of the cleaning elements may be angled at various angles with respect to the outer surface of head 614. It is thereby possible to select the combination of cleaning element configurations, materials and orientations to achieve specific intended results to deliver additional oral health benefits, like enhanced cleaning tooth polishing, tooth whitening and/or massaging of the gums.

Figure 5:
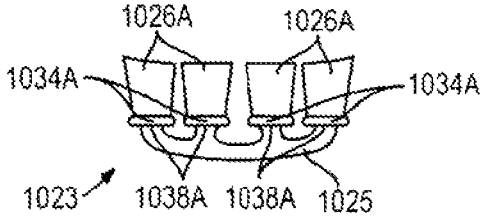
FIG. 5 is a side elevational view showing a subassembly of the bristle containing portion of a brush head in accordance with an aspect of the invention.
Figure 6:
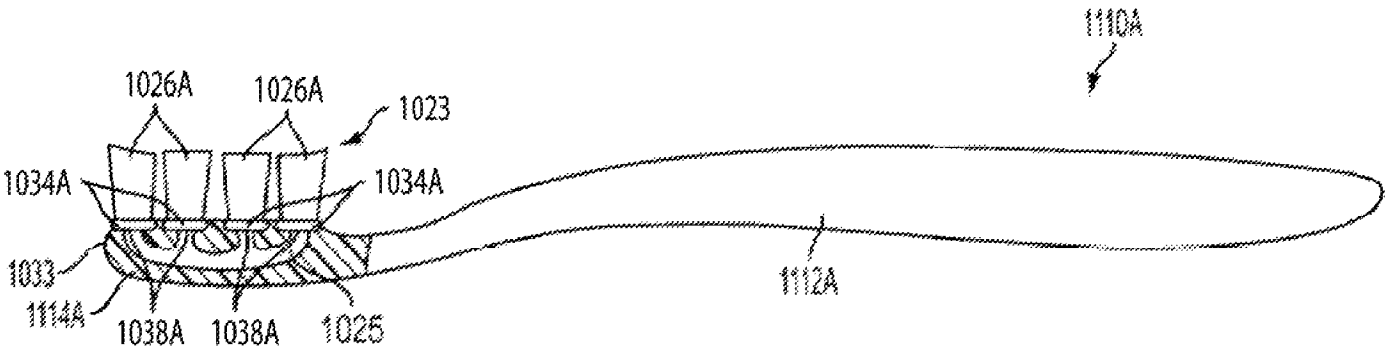
FIG. 6 is a side elevational view, in partial section, showing the subassembly of FIG. 5 incorporated in a completed toothbrush according to an embodiment of the invention.

FIGS. 5-6 illustrate a further embodiment of this invention. The toothbrush 1110A has the ability to provide flexible support for the bristles 1026A in designated areas. The flexibility is provided by designing the tuft holding areas or plates 1034A as plates, which in combination with the stems 1038A form pods having a mushroom shape. The mushroom stem 1038A is made flexible to allow the plate 1034A populated with bristles or cleaning elements 1026A to move in different directions while brushing, as described with respect to the flexible pods of FIGS. 1-4.

FIGS. 5-6 show the toothbrush 1110A and in particular the cleaning element or bristle carrying portion 1023 of the head 114A, which includes a base 1033. As shown in FIG. 5, the bristle or cleaning element carrying portion 1023 forms an initial subassembly. This subassembly is made by introducing the cleaning elements 1026A into the mold cavity into which a plastic material is injected. As the material injected cools off it permanently traps the bristles or cleaning elements 1026A to form a brush or subassembly 1023.

To achieve a functional flexibility and proper tuft retention the portion of the bristle holding part or subassembly 1023 which comprises the plates 1034A, stems 1038A and interconnecting support 1025 is preferably a blend of polypropylene (PP) and soft TPE. Once the PP/TPE blend is combined with the bristles 1026A the subassembly 1023 is formed. The subassembly 1023 is then overmolded with an entire toothbrush handle 1112A and head 1114A during a second injection cycle to form the completed toothbrush 110A shown in FIG. 6. If desired or required the entire handle 1112A and head 1114A absent the subassembly 1123 could be made first and the subassembly or bristle retaining portion 1123 made second. While an IMT process has been described, the subassembly could also be formed using an AFT process, wherein the cleaning elements are fused together and then captured within the plates, for example.

It is to be understood that the invention described in FIGS. 5-6 could be practiced where all portions of the head 1114A include the flexible mushroom sections without having less flexible base portions such as bases 616 and 620 of FIGS. 1-4. Similarly, the subassembly two shot techniques of FIGS. 5-6 could be utilized in the embodiment of FIGS. 1-4 for forming the two or more central pods as a single subassembly initially made separate from the remainder of the head 1114A. The final toothbrush would be made in a second injection molding process wherein the subassembly having interconnected pods 622, 624 would be molded to the handle 612 and head 614 made of more rigid material.

As noted, FIG. 2 illustrates the terminal surfaces of the cleaning elements 618 and 626 to be tapered in an up and down or zigzag manner. FIGS. 5-6 show an alternative taper wherein the terminal surfaces of all four cleaning elements collectively, form a smooth, gentle, concave shape. If desired, other shapes may be used such as a planar shape for the terminal surfaces or a convex shape as well as the zigzag or up and down shape shown in FIG. 2. Similarly, the terminal ends of the cleaning elements in the FIGS. 1-4 embodiment, as well as those of FIGS. 5-6, could have the various shapes such as zigzag, convex, concave or planar.

FIGS. 7-25E show additional embodiments of the invention that further illustrate the combinability of various aspects, features and functions disclosed herein into single oral care implement configurations. FIGS. 7-25E disclose oral care implement configurations that provide a tooth cleaner having separate groups of cleaning elements, which may each be mounted on a fixed base or a flexible pod, and which may provide a soft tissue cleaner in addition to the tooth cleaner. The configurations may be powered or manual devices, and the handles may include gripping features. As such, the oral care implements disclosed in FIGS. 7-25E generally include the aspects discussed along with FIGS. 1-6 pertaining to groups of cleaning elements that may include flexible pods. It is understood that other features may used along with these configurations, such as mechanical drive features discussed in co-pending application Ser. Nos. 11/122,224 and 10/768,363 (i.e., the heads of the various embodiments described herein could be vibrating heads) and tooth cleaning features discussed throughout the specification.

Figure 7:
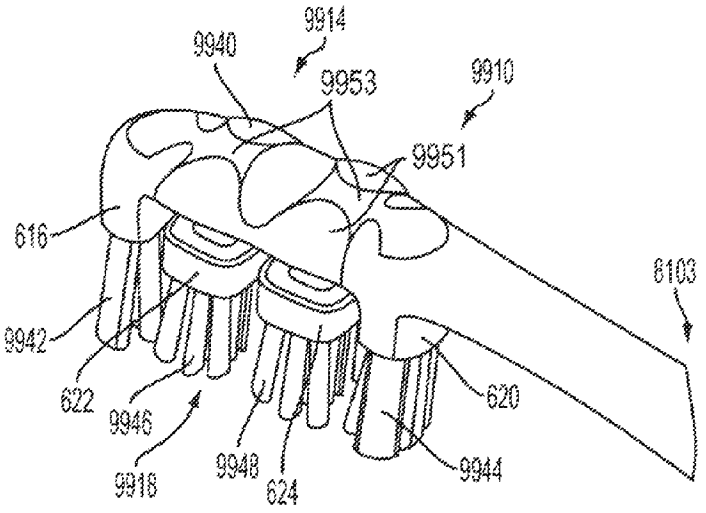
FIG. 7 is a perspective view of a head portion of an oral care implement in accordance with an embodiment of the invention.
Figure 8:
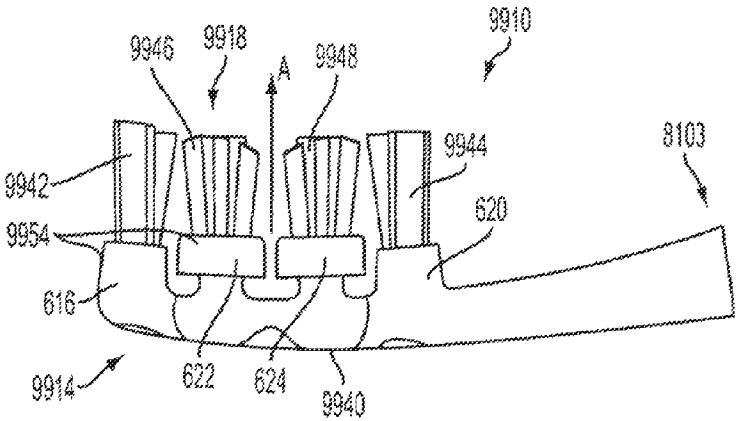
FIG. 8 is a side view of the head portion shown in FIG. 7.
Figure 9:
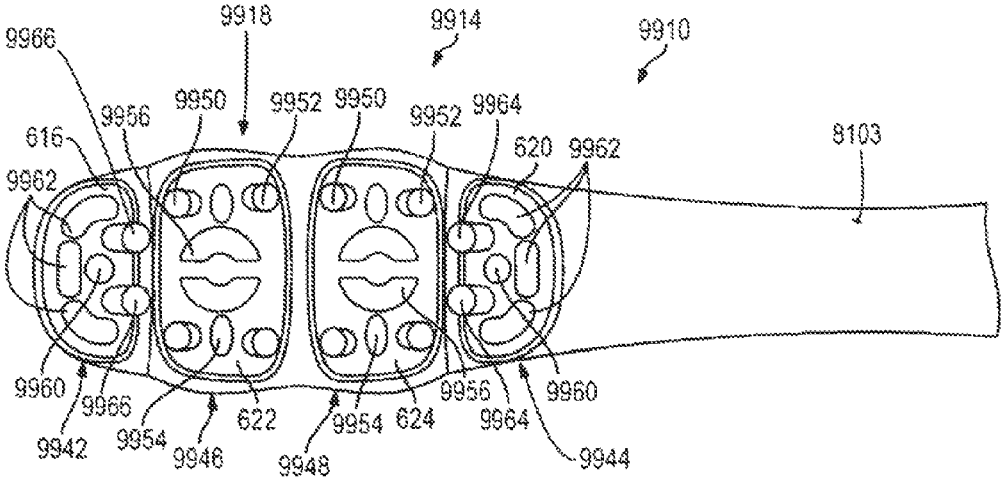
FIG. 9 is a top view of the head portion shown in FIGS. 7 and 8.

FIGS. 7-9 illustrate a portion of an oral care implement 9910, such as a toothbrush, in accordance with another embodiment of the invention. As shown therein, toothbrush 9910 includes a head 9914 and a handle 8103. Handle 8103 may be formed in accordance with the teachings of U.S.

patent application Ser. No. 10/902,257, filed Jul. 30, 2004, which is incorporated by reference herein, although other handle configurations may be used, such as handle 612, 1112A shown in FIGS. 1-6. Head 9914 is generally the same as head 614 discussed along with FIGS. 1-6, with the exception of cleaning elements 9918 and the contoured surface 9940 disposed on an opposite side of the head from the cleaning elements. Thus, head 9914 generally includes bases 616 and 620 that respectively support cleaning elements 9942 and 9944 in a substantially static configuration. Head 9914 also includes pods 622 and 624 disposed between the bases for respectively supporting cleaning elements 9946 and 9948. As discussed along with FIGS. 1-6, pods 622 and 624 can provide flexible mounts for cleaning elements 9946 and 9948 attached thereto, and may permit rotation and/or oscillation of the cleaning elements 9946 and 9948.

FIG. 7 shows a contoured surface 9940 disposed on an opposite side of the head from the cleaning elements. Contoured surface 9940 includes hills 9951 and valleys 9953 to provide a rolling or undulating surface on a rear face of the head. Surface 9940 may be relatively smooth for use with massaging oral tissues and, as illustrated in FIGS. 10 and 12-18, the surface may include soft tissue cleaning elements for engaging soft oral tissues and provide cleaning benefits thereto.

FIG. 9 is top view of head 9914, which shows a configuration of tooth cleaning elements 9918. Cleaning elements 9918 may be formed of elastomeric wall members, elongate bristle tufts, or other types of cleaning elements, which are independently flexible. In this way, the cleaning elements 9918 are able to provide a limited and controlled flow of the dentifrice, as well as maintain sufficient flexibility to provide improved cleaning of a user's teeth and stimulation of the user's gums via the cleaning elements.

Cleaning elements 9918 are oriented for engaging surfaces to be cleaned in a generally intended application direction A (see FIG. 8), which is generally perpendicular to the face of head 9914. Cleaning elements 9918, however, include a mixture of cleaning elements that are aligned with (non-angled) and oblique to direction A (angled). The arrangement of angled and non-angled cleaning elements provides effective engagement and cleaning of oral surfaces, which is further enhanced by the movable pods configuration. The cleaning elements 9946 and 9948 mounted on pods 622 and 624 are adapted to engage a user's teeth, gums and other surfaces in a various ways that take advantage of their flexible support configuration. As such, as shown in FIG. 9, cleaning elements 9946 and 9948 include forward elements 9950 angled toward the tip end of the head, and rearward elements 9952 angled toward the handle. As shown in FIG. 9, the forward and rearward elements 9950, 9952 are preferably placed on the forward and rearward sides of their respective pods, and more preferably, are placed in the corner regions of the pods 622, 624. Such a location and orientation increases the likelihood that elements 9950 and 9952 will initially engage a surface to be cleaned prior to other cleaning elements on the respective pod, which encourages the respective pod to flex as the remaining cleaning elements thereon are engaging the surface.

For instance, as oral care implement 9910 is moved forward such that head 9914 leads the toothbrush, forward elements 9950 will initially engage surfaces to be cleaned prior to rearward elements 9952 or other cleaning elements (see, e.g., elements 9956) disposed between elements 9950 and 9952. The forward angle of elements 9950 will encourage pods 622 and 624 to bend rearward when the forward elements contact a surface to be cleaned while the toothbrush is moving forward. The rearward bending of the pods, and their action of springing forward in response to the bending, enhances the cleaning effectiveness of the cleaning elements 9946 and 9948 disposed on the pods. The angled configuration of elements 9950 and 9952 improves the bending of the pods in comparison with alternate embodiments are angled neither forward nor rearward.

Cleaning elements 9946 and 9948 of the pods also include non-angled cleaning elements 9954, which are beneficial for penetrating surfaces to be cleaned. In addition, cleaning elements 9946 and 9948 include a pair of bent, upstanding walls 9956 in a central portion of the pods. Such walls could be formed as a densely packed bristle tuft by an IMT or AFT process, or such walls could include elastomeric elements. Other configurations are contemplated. Each one of the walls in the pair 9956 has a concave side opposing the concave side of the other wall in the pair. The bent configuration and opposed convex sides of upstanding walls 9956 improve retention of dentifrice therebetween during use of the oral care implement. In addition, the bent configuration provides a pair of rigid walls, which, in their central location of the pod, supports the pod to prevent overflexing of the cleaning elements 9946, 9948.

Cleaning elements 9942 and 9944 disposed on static bases 616 and 620 are configured to cooperate with cleaning elements 9946 and 9948 on the movable pods, as well as to effectively clean oral surfaces. As shown in FIG. 9, the bases 622, 624 each include a bristle 9960, a series of upstanding walls 9962, and angled cleaning elements 9964, 9966. Bristle 9960 is generally a non-angled column that effectively penetrates gaps and recesses between oral structures (e.g., teeth).

The series of upstanding walls 9962 are arranged to generally form a concave wall directed toward the remaining cleaning elements. Thus, the concave wall 9962 of the front base 616 has its concave side directed rearward toward the handle, and the concave wall on the rear base 620 has its concave side directed forward toward the remainder of the cleaning elements. In such a configuration, the opposing concave walls work in concert to retain dentifrice within the field of bristles 9918 via their concave shape that cups the dentifrice, as well as via small gaps between the upstanding walls 9962 that form the concave walls, which reduce the flow of dentifrice therebetween. In addition, the upstanding walls forming the concave walls are non-angled cleaning elements that provide support to the head 9914 during use and resist overflexing of the cleaning elements when excessive downward force is applied by the user.

Angled cleaning elements 9964 and 9964 are angled toward the movable pods 622 and 624 to cooperate with cleaning elements 9946 and 9948 attached thereto for effectively cleaning oral surfaces. As such, rear base 620 includes forward angled elements 9964, and front base 616 includes rearward angled elements 9966. Angled cleaning elements 9964 and 9966 are disposed adjacent the cleaning elements 9950 and 9952 of the movable pods. Thus, as the pods flex back and forth, angled cleaning elements 9950 and 9952 interpose between corresponding angled cleaning elements 9964 and 9966. This provides a scissor-like action that enhances cleaning effectiveness and avoids interference between opposing cleaning elements 9964, 9966 and 9952, 9950 that may limit movement of the pods 622, 624.

The cleaning elements described in connection with the embodiment of FIGS. 7-9, as well as the embodiments to follow, are preferably formed using an AFT technique as is known in the art. This technique facilitates the arrangement of cleaning element constructions that depart from the traditional stapled perpendicular tuft. With AFT technology, the anchored ends of the cleaning elements are melted together to form a block of cleaning elements, that can then be arranged on a head plate with various dimensions, angles and orientations. Thus, the blocks of cleaning elements are generally captured within the pod structures, not embedded in a supporting medium.

Figure 10:
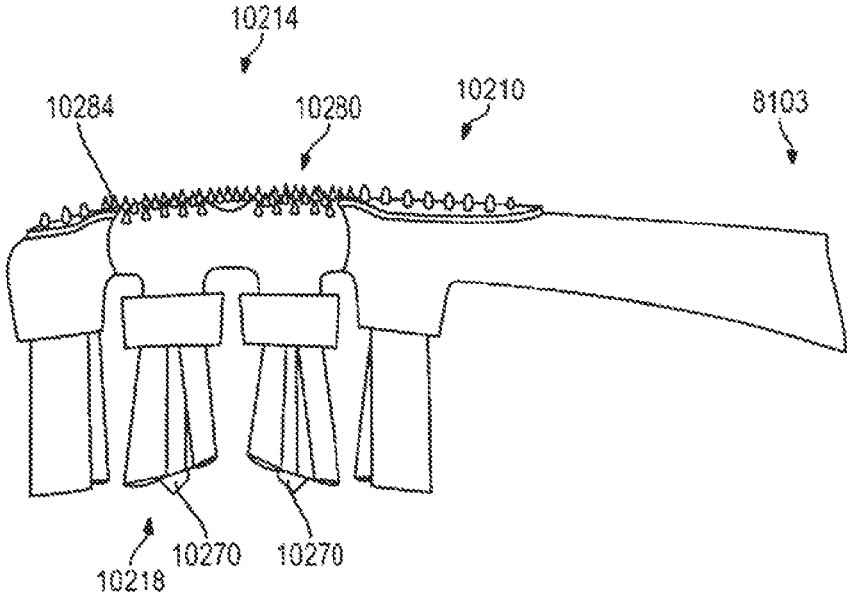
FIG. 10 is a side view of a head portion of an oral care implement in accordance with an embodiment of the invention.

Referring now to FIGS. 10-13, an oral care implement 10210 is shown in accordance with a further embodiment of the invention. As shown therein, oral care implement 10210 includes a handle 8103, a head 10214 having cleaning elements 10218 attached thereto on a first side of the head, and a soft tissue cleaner 10280 disposed on a second side of the head that is opposite to the first side. Oral care implement 10210 generally includes the aspects and features of oral care implement 9910, except as pertaining to the configuration of cleaning elements and the soft tissue cleaning features. Cleaning elements 10218 primarily include upstanding walls, which may include an elastomeric element, or may be formed as a densely packed bristle tuft by an IMT or AFT process. Other configurations are contemplated. The upstanding walls provide beneficial wiping and polishing of teeth, in addition to cleaning benefits. Cleaning elements 10218 also include a central columnar cleaning element 10270, which may be a bristle, for penetrating oral surfaces. As shown in FIG. 10, each central cleaning element 10270 extends beyond other cleaning elements proximate thereto on the same pod. In addition, central cleaning element has a pointed tip. As such, central cleaning element 10270 effectively penetrates and engages oral surfaces and gaps between surfaces.

Figure 11:
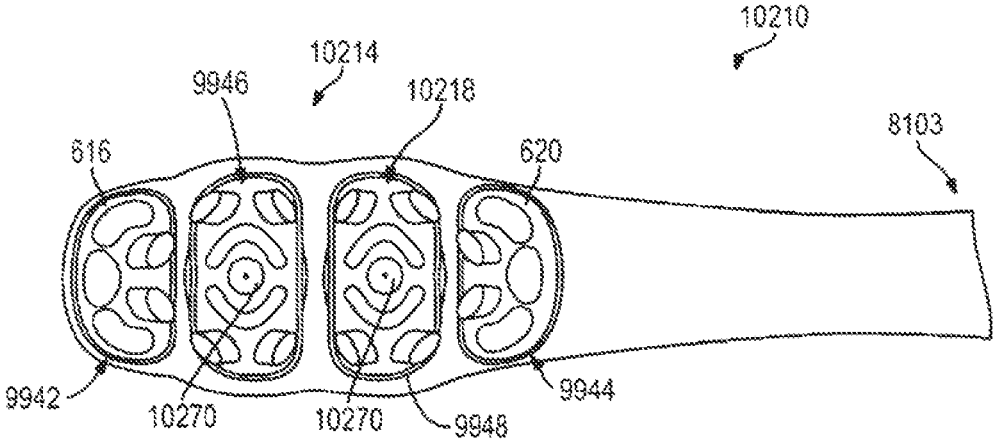
FIG. 11 is a top view of the head portion shown in FIG. 10.
Figure 12:
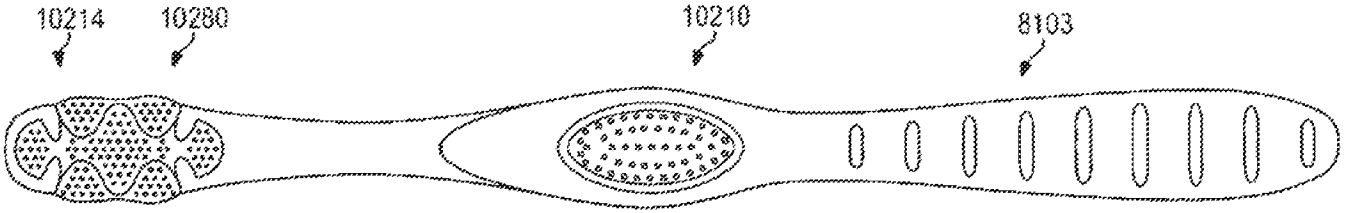
FIG. 12 is a top view of a soft tissue cleaner side of an oral care implement in accordance with a further embodiment of the invention.

Similar to the configuration of FIGS. 4 and 7, and as shown in FIG. 11, the tips or terminal ends of cleaning elements 10218 are tapered such that the pods are respectively encouraged toward their adjacent static base while engaging surfaces to be cleaned. Thus, during use, cleaning elements 9948 are generally biased toward engagement with cleaning elements 9944 on rear base 620, and cleaning elements 9946 are generally biased toward engagement with cleaning elements 9942 on front base 616. This bias can work along with movement of the pods that is imparted via engagement of angled cleaning elements with cleaning surfaces when the device is being moved. Increasing movement and the flexing of bases 622 and 624 further enhances the cleaning effectiveness of the oral care implement.

The soft tissue cleaner 10280 includes a plurality of projections 10281 extending from a face 10284 on a second side of head 10214, which is generally opposite from the direction in which tooth cleaning elements 10218 extend. Soft tissue cleaner 10280 is disposed on a contoured surface, such as contoured surface 9940 shown in FIG. 7, which includes hills 9951 and valleys 9953 to provide a rolling or undulating surface on a second face of the head. Projections 10281 may be separately molded and glued to the contoured surface or otherwise attached thereto. In addition, they may be integrally formed with the head 10214. The projections could each be made from a material different from other projections and/or different from other parts. Soft materials, such as a TPE or the like, can be fixed to head 10214 to form the projections. However, a harder material or virtually any known material used to make oral care implements may be appropriate for the projections.

Projections 10281 include a plurality of nubs 10282, which extend from contoured surface 9940 to engage the soft tissue in a user's mouth. The projections 10281 could have a variety of shapes, patterns, cross-sections, configurations, etc., and the soft tissue cleaner could have a variety of configurations for the projections.

Figure 13:
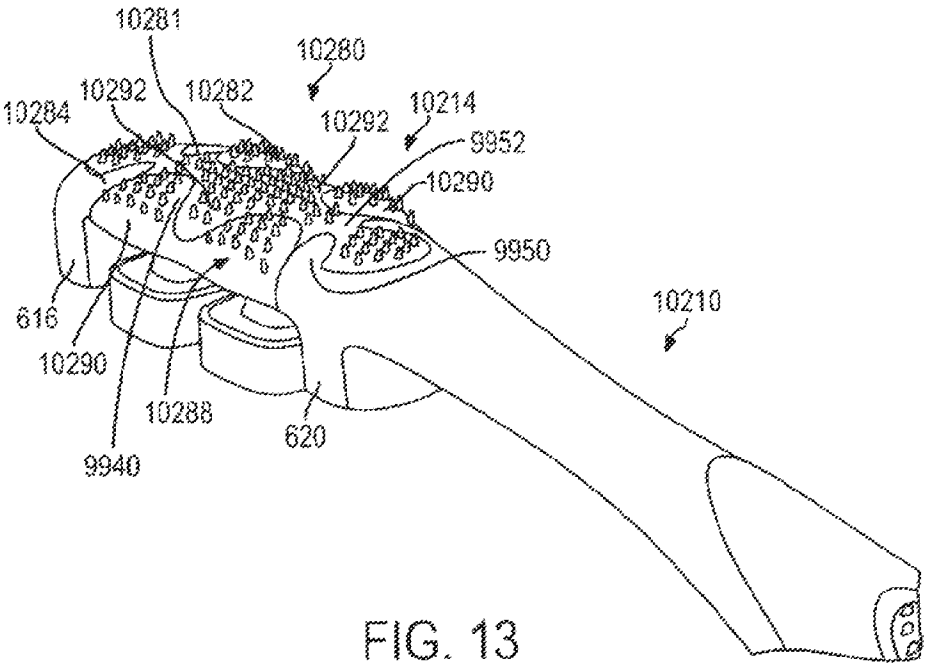
FIG. 13 is a partial perspective view of the oral care implement of FIG. 12 without tooth cleaning elements.

As shown in FIG. 13, nubs 10282 generally cover rear face 10284 in a cleaner field 10288, which extends from a region opposite the rear base 620 at a lower portion of the head to a region opposite the front base 616 at a tip portion of the head. The nubs 10288 are dispersed in a substantially continuous pattern over the cleaner field 10288. The cleaner field 10288 includes hills 10290, proximate the edge portions of face 10284, and valleys 10292, disposed between the hills and at a central portion of the face. The configuration of hills and valleys enhances the effectiveness of the soft tissue cleaner by concentrating the applied force at the hill portions during initial contact with a user's soft tissue, which can increase penetration into the soft tissue versus a relatively flat configuration. As the user applies additional force, the valleys contact the soft tissue to aid in cleaning the soft tissues. If excessive force is applied, the valleys help to limit excessive penetration. When the nubs 10282 in the valley regions 10292 engage the soft tissue, they provide the added benefit of dislodging debris that is loosened by the deeper penetration of nubs 10282 on the hills 10290. Thus, projections on the hills and valleys work in concert to initially loosen and then dislodge debris in a user's soft tissue.

Figure 14:
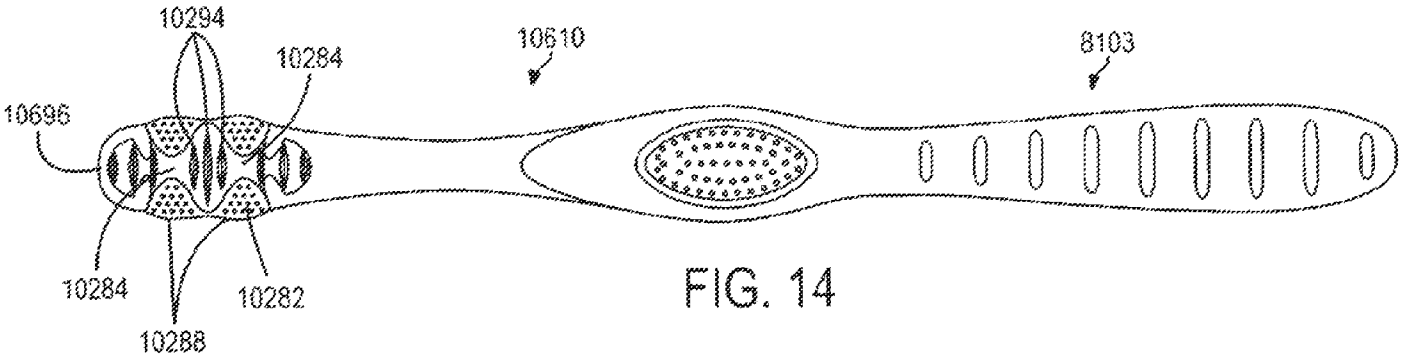
FIG. 14 is a top view of an oral care implement in accordance with a further embodiment of the invention.
Figure 15:
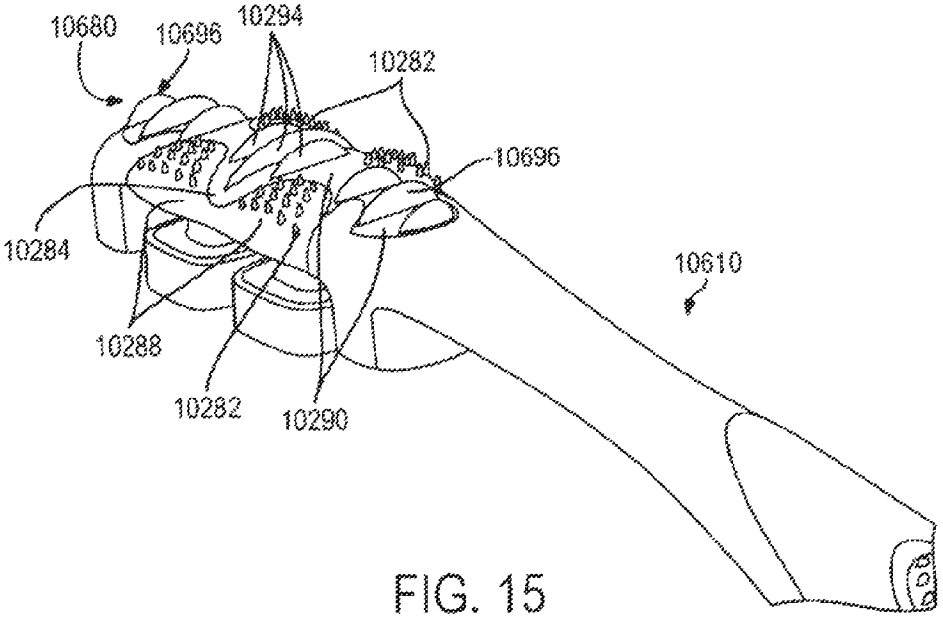
FIG. 15 is a partial perspective view of the oral care implement of FIG. 14 without tooth cleaning elements.

FIGS. 14 and 15 illustrate another embodiment 10610 of an oral care implement according to the invention. Oral care implement 10610 generally includes the same aspects and features of oral care implement 10210, except with respect to the configuration of projections on the soft tissue cleaner 10680. Rather than having nubs across the cleaner field, soft tissue cleaner 10680 only includes nubs 10282 on the hills 10288. Instead, multiple ridges 10294 are disposed in some of the valley regions 10290 including a central portion of face 10284. The ridges can be made from the same or a different material than the nubs. For instance, the nubs and ridges may be made of the same type of elastomer; however, the elastomer for the ridges may be more rigid than that for the nubs.

Ridges 10294 have variable lengths that provide variable levels of soft tissue engagement during use. As such, longer and shorter ridges can work in concert to loosen and dislodge debris as the different lengths of ridges successively engage portions of soft tissue. Ridges 10294 taper from a wide base region disposed proximate the face 10284, to a narrower tip 10696. Thus, increasing levels of soft tissue engagement are provided depending on the amount of user force applied.

Figure 16:
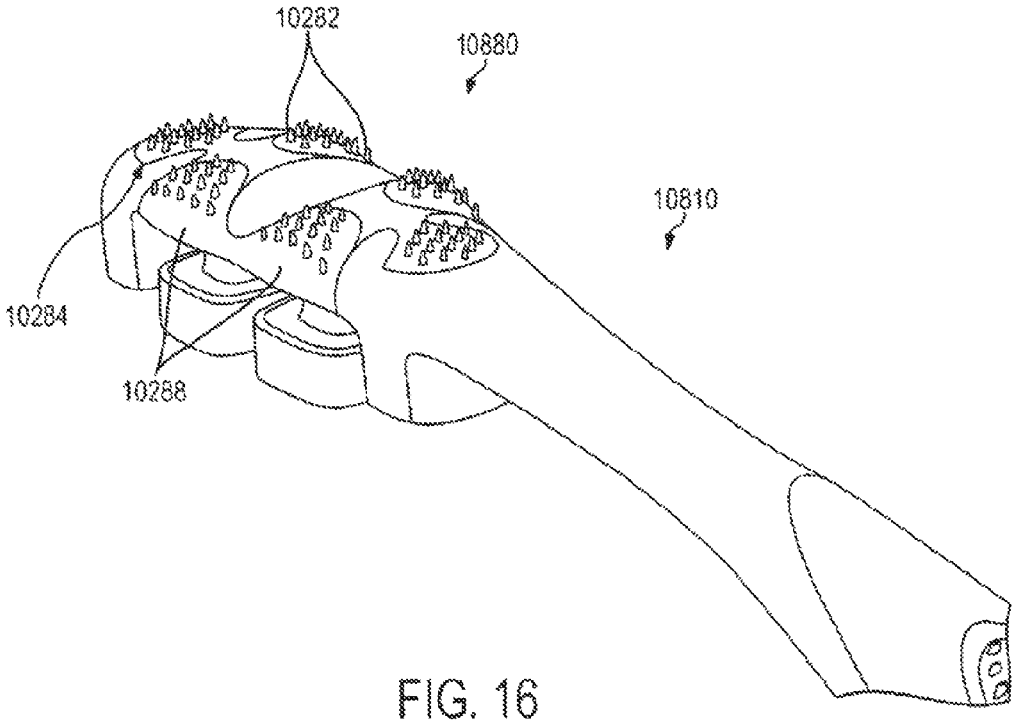
FIG. 16 is a partial perspective view of an oral care implement according to a further embodiment of the invention without tooth cleaning elements.

FIG. 16 illustrates another embodiment 10810 of an oral care implement according to the invention. Oral care implement 10810 generally includes the same aspect and features of oral care implement 10610, except with respect to the configuration of projections on the soft tissue cleaner 10880. Soft tissue cleaner 10880 differs from soft tissue cleaner 10680 in that it does not include ridges 10294. Thus, soft tissue cleaner includes nubs 10282 that are only located on hills 10288 along the side portions of face 10284. As such, gentle cleaning is provided via the nubs located on the hills. The gentle cleaning is beneficial for simultaneous functionality of the oral care implement, such as when a user cleans his teeth while simultaneously engaging soft tissues inside his cheek via soft tissue cleaner 10880. The gentle engagement can provide pleasant sensory stimulation along with gentle cleaning of the soft tissues.

Figure 17:
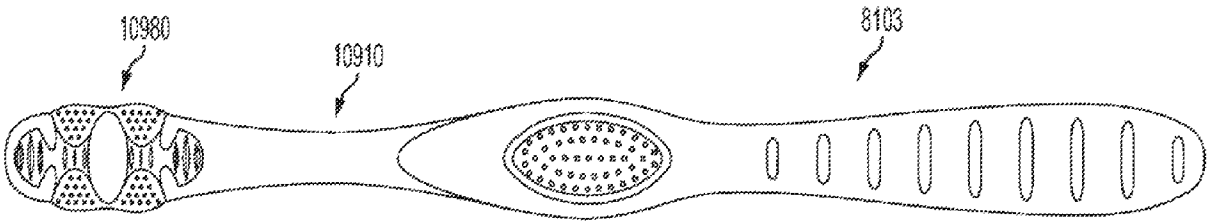
FIG. 17 is a top view of an oral care implement in accordance with a further embodiment of the invention.
Figure 18:
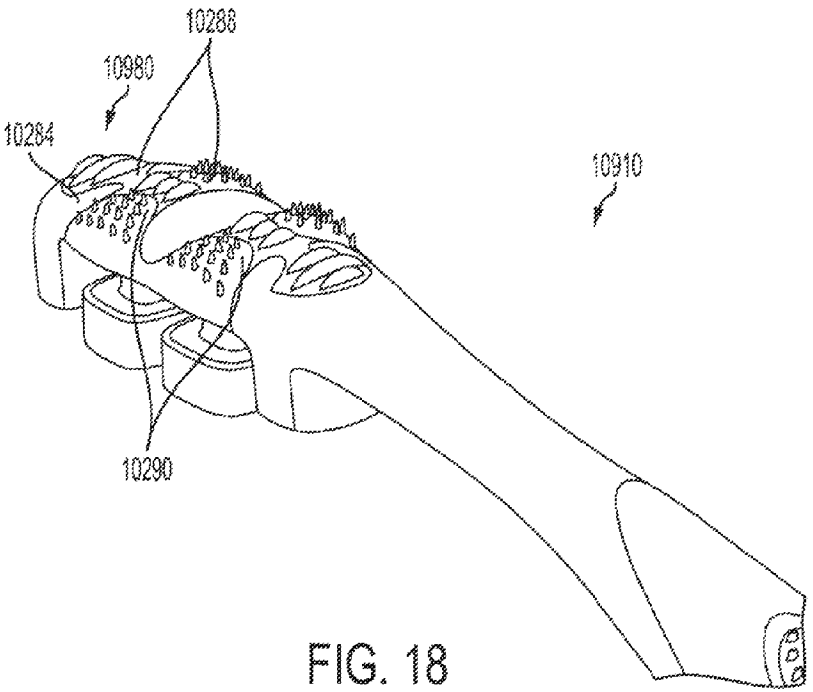
FIG. 18 is a partial perspective view of the oral care implement of FIG. 17 without tooth cleaning elements.

FIGS. 17 and 18 illustrate another embodiment 10910 of an oral care implement according to the invention. Oral care implement 10910 generally includes the same aspects and features of oral care implement 10610, except with respect to the configuration of projections on the soft tissue cleaner 10980. Soft tissue cleaner 10980 differs from soft tissue cleaner 10680 in that ridges 10294 are not provided in the central portion of face 10284. Ridges 10294' are provided in valleys 10290 disposed between adjacent pairs of hills 10288. In addition, ridges 10294' are generally smaller than ridges 10294. As such, gentle cleaning is provided, which, similar to oral care implement 10810, can be beneficial during simultaneous functionality of the device.

Figure 19:
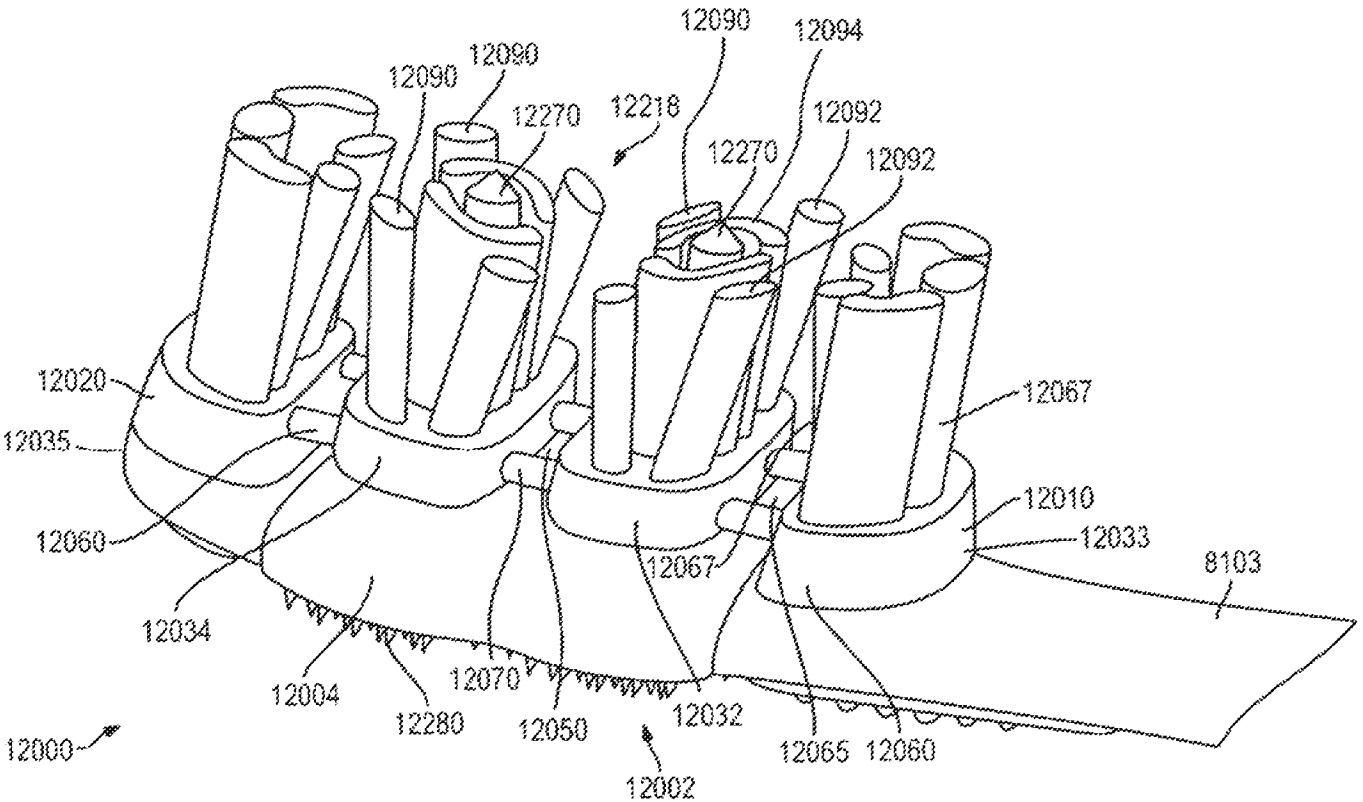
FIG. 19 is partial perspective view of an oral care implement according to an embodiment of the invention.
Figure 20:
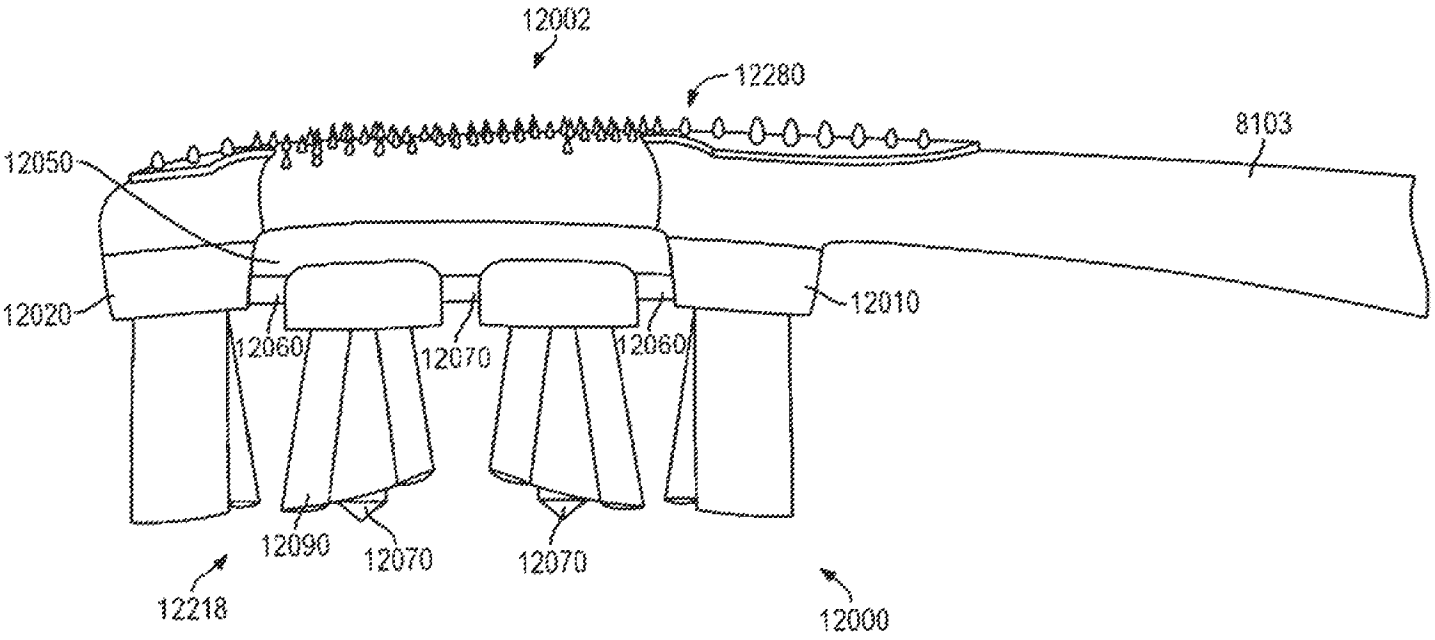
FIG. 20 is a side elevational view of the oral care implement of FIG. 19.

Referring now to FIGS. 19-20 an oral care implement 12000 is shown in accordance with a further embodiment of the invention. As shown therein, oral care implement 12000 includes a handle 8103, a head 12002 having a frame 12004 (which forms a base structure of the head), bases or pods 12010, 12020, 12032 and 12034 on a front side of the head, cleaning elements 12218 extending from the pods, and a soft tissue cleaner 12280 disposed on a rear side of the head that is opposite to the front side. Oral care implement 12000 generally includes the aspects and features of oral care implement 10210 shown in FIGS. 10-13, except as discussed hereafter. The soft tissue cleaner 12280 is generally the same as soft tissue cleaner 10280. However, various soft tissue cleaner configurations may be used, such as, for example, the soft tissue cleaners of FIGS. 14-18.

Oral care implement 12000 shown in FIGS. 19 and 20 is illustrated as having four pods: a proximal pod 12010, a distal pod 12020 and two central pods 12032 and 12034. The proximal and distal pods extend from frame 12004, which is on a rear portion of the head. The embodiment shown in FIGS. 19 and 20 differs from the embodiments shown in FIGS. 1-18 in that the central pods 12032 and 12034 are not connected directly to the rear, frame portion of head 12002, but rather are suspended between the proximal pod 12010 and the distal pod 12020. The proximal pod and the distal pod are attached to the frame, whereas the central pods are suspended over the frame. As such, the central pods are spaced from the frame 12004 such that a gap 12050 is disposed therebetween.

Central pods 12032 and 12034 are suspended via bridge supports 12060, which may include a pair of substantially parallel supports 12060 separated by a gap 12065. A first bridge support extends longitudinally between the proximal pod 12010 and central pod 12034, and a second pair of bridge supports extends longitudinally between distal pod 12020 and central pod 12034. In addition, a bridge support 12070 extends longitudinally between central pods 12032 and 12034. The central bridge support 12070 also includes a pair of parallel supports with a gap therebetween. Thus, each central pod is supported by a pair of opposite bridge supports.

While the illustrated embodiment shows pairs of supports 12060 on each side of each central pod, other configurations are contemplated. For example, instead of a pair of supports 12060, a single bridge element may be disposed between the proximal or distal pod and the adjacent central pod, and between the two central pods. Such a single bridge could be wider than each of the individual pair of supports 12060 such that the width of the single bridge support generally equals the width of the pair of supports plus gap 12065 therebetween.

The central pods 12032 and 12034 generally have greater degrees of freedom than do the proximal and distal pods. In one configuration, bridge supports 12060 and 12070 are substantially rigid. Even so, the suspension arrangement can provide a moderate amount of flexibility to the central pods. In a preferred, more flexible configuration, bridge supports 12060 and 12070 are flexible features that permit the cleaning elements extending from the central pods 12032 and 12034 to have a much larger range of motion than the cleaning elements extending from the proximal and distal pods 12010 and 12020, respectively, which are generally static or non-movable. The flexible bridge supports may be formed from a resilient material, such as a thermoplastic elastomer. Other rubber-like materials may be used, such as other thermoplastics, or a thermoplastic urethane, or a plastomer, or any combination thereof.

In a flexible configuration, bridge supports 12060 and 12070 are resilient and allow the central pods to twist about their support axis (which in the illustrated embodiment would extend substantially parallel to the longitudinal axis of the head) and/or move toward frame 12004 when downward force is applied to the central pods during use of the implement. Further, the elastic nature of the bridge supports may permit the central pods to return to their original form or initial position when the force is decreased. In addition, when the oral care implement is moved in a longitudinal direction parallel to the handle 8103, the central pods can deflect longitudinally as they engage a surface to be cleaned. The deflection of the central pods in the longitudinal direction may also be due to the elastic nature of the support bridges 12060 and 12070. Such return action can create an active motion in the opposite direction of the direction of movement, which aids in the cleaning of teeth by introducing extra brushing strokes.

The distance between the proximal pod 12010 and the distal pod 12020 may be greater than the width of the each of the central pods 12032 and 12034, and in the illustrated embodiment of FIG. 19 is approximately twice the width of one of the central pods. Further, in the illustrated embodiment, the central pods 12032 and 12034 are suspended away from the frame a distance slightly less than the thickness of the central pods 12032 and 12034. The length of the support bridges 12060 and 12070 may be significantly less than the length of the central pods 12032 and 12034, and, in the configuration shown in FIGS. 19 and 20, is approximately ⅕ the length of the central pods. As a result, with two central pods of the configuration shown in FIGS. 19 and 20, the support bridges 12060 and 12070 span less than 25% of the total distance between the proximal and distal pods 12010 and 12020, respectively.

In addition, the configuration shown in FIGS. 19 and 20 includes a unitary assembly that forms a top portion of proximal pod 12010, the top of distal pod 12020, bridge supports 12060 and 12070 and central pods 12032 and 12034. The unitary assembly may be made from an elastomeric material, such as a soft thermoplastic elastomer (TPE). Again, other rubber-like materials may be used, such as other thermoplastics, or a thermoplastic urethane, or a plastomer, or any combination thereof. The top portions 12033 and 12035 of the proximal and distal pods can be attached to protrusions (not shown) extending from the underlying head 12002, thereby providing sufficient support and strength to the proximal and distal pods 12010 and 12020. The top portions may also be formed as unitary features along with the frame of the head, such as from a unitary plastic mold. When formed as differentiated features, the proximal and distal pods could be formed from the same or different materials than the frame, the bridge supports and/or the central pods. For instance, the bridge supports and central pods could be made from a first thermoplastic material, and the proximal and distal pods could be formed separately from a second thermoplastic material, such as polypropylene. In such a configuration, the bridge supports and the central pods could be made as a unitary construction that is welded or adhered to the proximal and distal pods. Further, the bridge supports, the central pods, and the top portions of the proximal and distal pods could be formed as a unitary member that is attached to the frame.

As discussed with regard to the embodiment shown in FIGS. 7 and 8, the cleaning elements 12218 mounted on the central pods can be adapted to engage a user's teeth, gums and other surfaces in a various ways that take advantage of their flexible support configuration. For instance, as shown in FIGS. 19 and 20, the cleaning elements provided on the central pods can include forward elements 12090 angled toward the tip end of the head, and rearward elements 12092 angled toward the handle end. The location and orientation of these forward and rearward elements can increase the likelihood such elements will initially engage a surface to be cleaned prior to other cleaning elements on the respective pod, thereby encouraging the respective pod to flex as the remaining cleaning elements thereon engage the surface.

As further shown in FIGS. 19 and 20, cleaning elements 12218 may include upstanding walls 12094, which may be elastomeric or bristle-based as discussed above. The upstanding walls can provide beneficial wiping and polishing of teeth in addition to cleaning benefits. Cleaning elements 12218 may further include a central columnar cleaning element 12270, which may include one or more bristles for penetrating oral surfaces. The columnar cleaning elements may extend beyond other cleaning elements proximate thereto on the same pod, and they may have a generally pointed tip. As such, central cleaning element 12270 can effectively penetrate and engage oral surfaces and gaps between surfaces.

The tips or terminal ends of cleaning elements 12218 may be tapered such that the suspended pods are respectively encouraged toward their adjacent proximal or distal pod 12020 and 12010, respectively, while engaging surfaces to be cleaned. Thus, during use, cleaning elements extending from central pod 12032 may generally be biased toward engagement with cleaning elements extending from proximal pod 12010, whereas cleaning elements extending from central pod 12034 may generally be biased toward engagement with cleaning elements extending from distal pod 12020. This bias can cooperate with movement of the pods imparted via engagement of angled cleaning elements with cleaning surfaces when the device is being moved. Increasing movement and the flexing of the suspended central pods 12032 and 12034 further enhances the cleaning effectiveness of the oral care implement.

Figure 21:
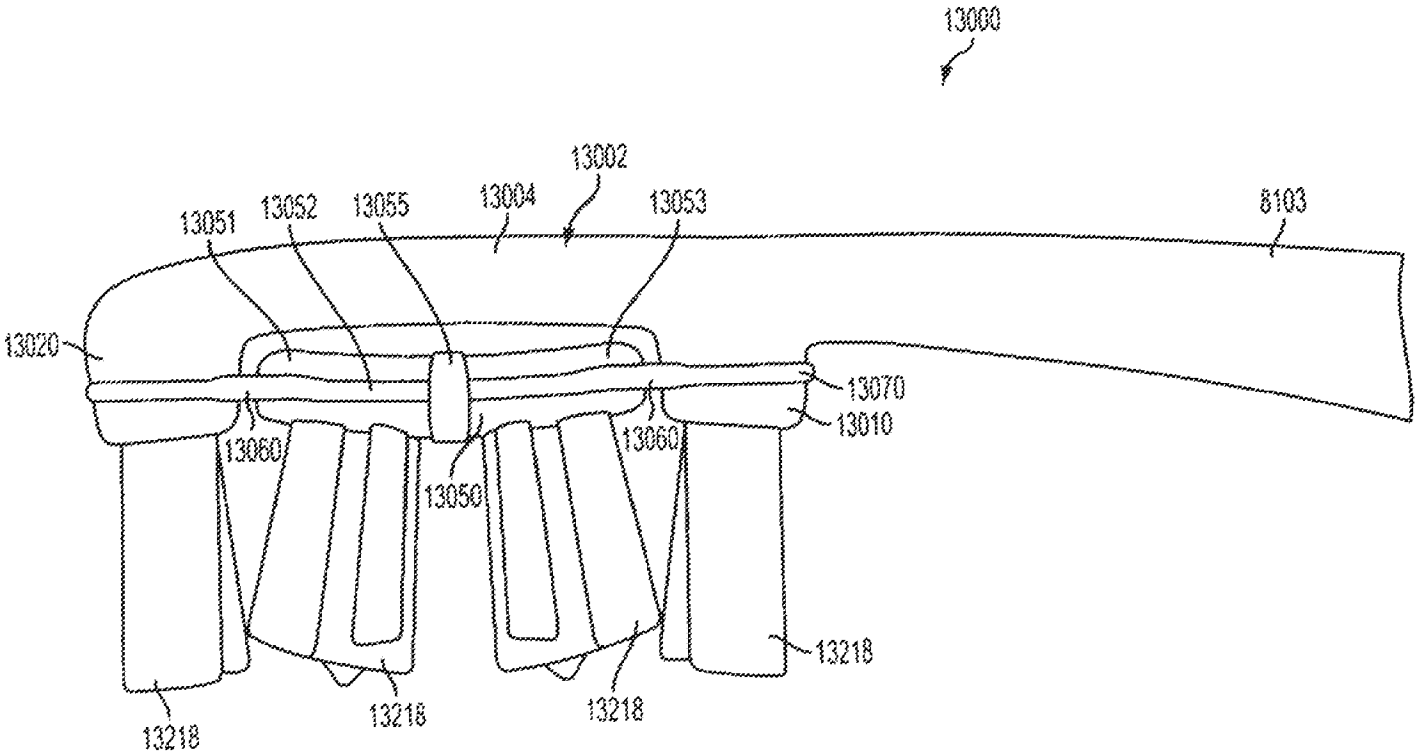
FIG. 21 is a side elevational view of a further embodiment of an oral care implement.

Referring now to FIG. 21, an oral care implement, in the form of a toothbrush 13000, is shown that is similar to the embodiment illustrated in FIGS. 19 and 20 and generally has the same aspects and features, except as pertaining to its central pod and the configuration of cleaning elements 13218 and its lack of a soft tissue cleaner. Toothbrush 13000 includes a handle 8103 and a head 13002 having a combination of fixed and suspended cleaning elements. Head 13002 includes a frame 13004, proximal and distal pods 13010 and 13020, and a single central pod 13050 suspended between the proximal and distal pods. The handle 8103, head 13002 and proximal and distal pods 13010 and 13020 may be formed as a unitary construction from a thermoplastic, such as polypropylene.

Single central pod 13050 has an elastomeric section 13055 disposed in a middle portion of the central pod. The elastomeric section is preferably made from a resilient material, such as a soft thermoplastic elastomer (TPE), while the central pod is preferably made from more rigid material, such as polypropylene. The central pod 13050 is held in place by a molded TPE membrane 13070 that connects with the proximal and distal pods 13010 and 13020 to form bridge supports 13060. The membrane 13070 may form a loop that encompasses the pair of fixed proximal and distal pods 13010 and 13020 and attaches to opposing sides of central pod 13050. Grooves (not shown) in side portions of the proximal and distal pods, as well as the central pod, may receive membrane 13070. In addition, membrane 13070 may be attached to the pods via an adhesive and/or a melt bond.

Membrane 13070 allows the central pod 13050 to move toward frame 13004 when sufficient force is applied during a cleaning operation. When such force is applied to the central pod, opposite halves 13051 and 13053 of the central pod will also flex about the elastomeric section 13055. As a result, the two sets of cleaning elements 13218 extending from either end of the central pod 13050 can rotate toward one another. The central pod 13050 can flex back to its original position when the force on the central pod moving it toward the head 13002 diminishes.

Cleaning elements 13218 extending from central pod 13050 are generally centrally-tapered, which is generally an opposite orientation to the configuration of cleaning elements shown in FIGS. 10 and 11 and FIGS. 19 and 20. The central taper encourages cleaning elements 13218 to penetrate interproximal spaces of the user's teeth while applying moderate force to toothbrush 13000 against their teeth. When the user applies more excessive force to the toothbrush, central pod 13050 moves into contact with frame 13004 and causes the central pod to bend about elastomeric section 13055 and further engage the interproximal space to which the cleaning elements are applied.

Figure 22A:
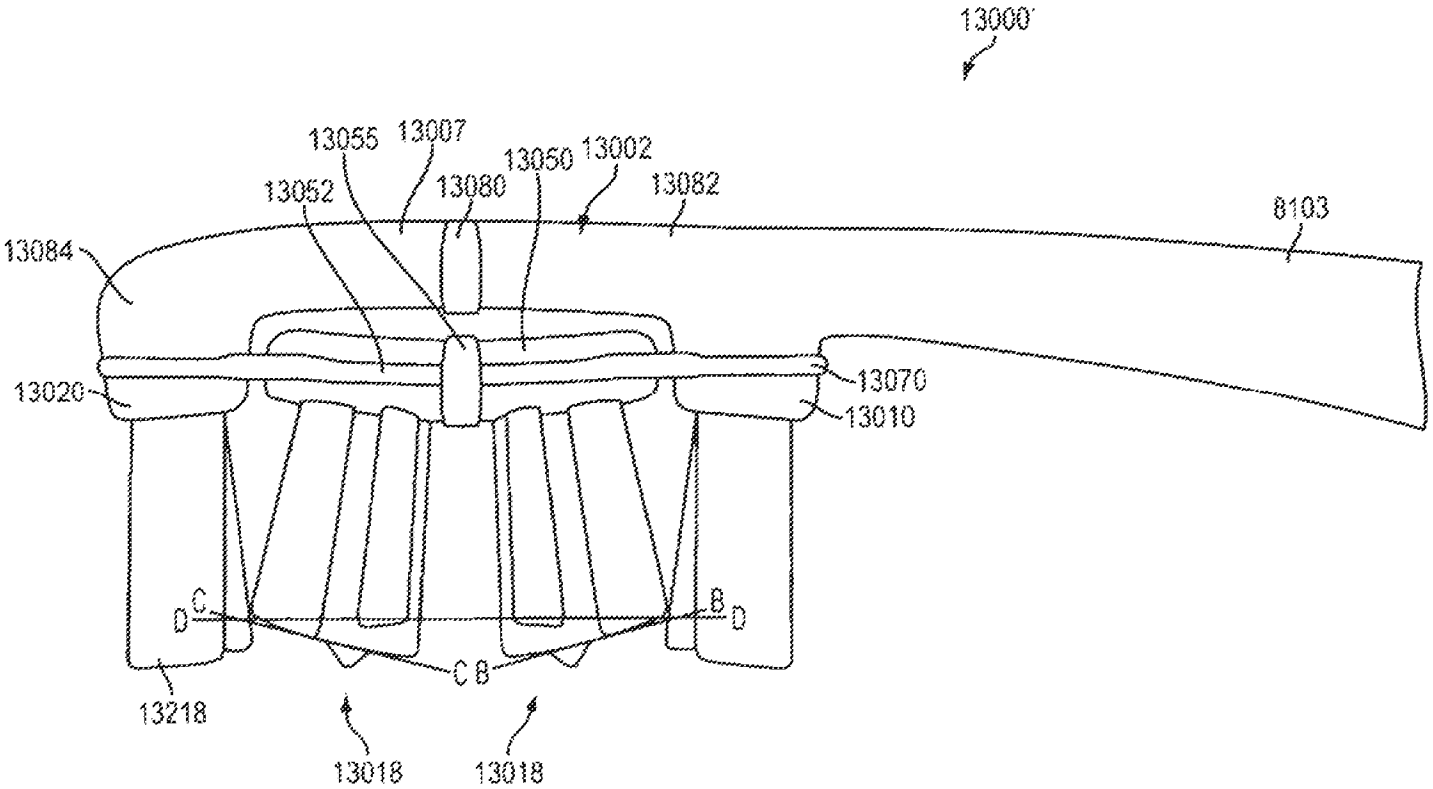
FIG. 22A is a side elevational view of another embodiment of an oral care implement.
Figure 22B:
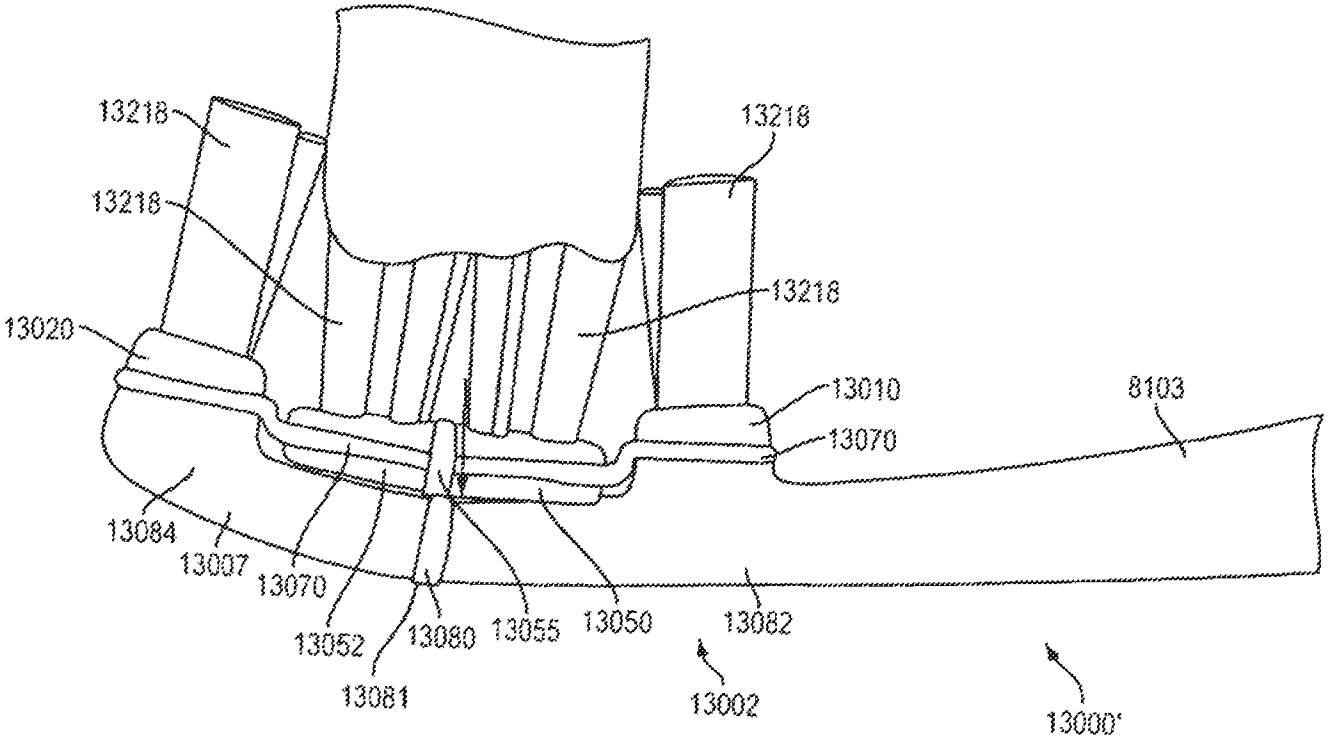
FIG. 22B shows the oral care implement of FIG. 22A while engaging a tooth.

Referring now to FIGS. 22A and 22B, an oral care implement, in the form of a toothbrush 13000', is shown that is similar to the embodiment illustrated in FIG. 21 and generally has the same the aspects and features as toothbrush 13000, except as pertaining to its frame. As shown, frame 13007 includes a resilient hinge element 13080 located in a central portion of the frame and traversing its width. The hinge element may be formed from a TPE or other resilient material that is more flexible than other portions of the frame. The hinge element may also include a reduced thickness region of the frame about which a TPE or other resilient material is disposed. For instance, a proximal portion 13082 of the frame and a distal portion 13084 of the frame may be formed from a relatively rigid material, such as a polypropylene material, and may include a thin neck region (not shown) disposed therebetween. The neck region may permit the proximal and distal portion of the frame to rotate with respect to each other. A resilient material 13081 (FIG. 22B) may surround the neck to dampen rotation about the neck. The resilient material may be adhered to the frame via an adhesive bond, a melt bond or other attachment mechanism, such as a compression fit about the neck.

Hinge element 13080 permits proximal and distal portions 13082 and 13084 respectively of frame 13004 to rotate with respect to one another during use. Thus, head 13002 can generally curl or bend around a surface to be cleaned, such as a user's tooth as illustrated in FIG. 22B. In addition, hinge element 13080 can simply improve the overall flexibility of the head for adapting to a variety of cleaning features, orientations of use, and applied forces. For instance, as shown in FIG. 22B, hinge element 13080 can permit frame 13007 to flex like a bow. In another example (not shown), hinge element 13080 can permit the tip portion of the head to be flexed rearward, which will encourage central pod 13050 to move away from the frame as the bridge supports are stretched taut. As shown, the cleaning elements 13018 are angled along lines C and B with respect to horizontal plane D Referring now to FIGS. 23A and 23B, an oral care implement, in the form of toothbrush 13020, is shown that is similar to the embodiment illustrated in FIG. 21 and generally has the same the aspects and features as toothbrush 13000 1300', except as pertaining to its central pod, the arrangement of cleaning elements 13218, and the existence of a soft tissue cleaner 13280 disposed on a rear side of its head that is opposite to the front side. The soft tissue cleaner 13280 is generally the same as soft tissue cleaners 10280 and 12280 of FIGS. 10-13 and 19-20 respectively. However, various soft tissue cleaner configurations may be used, such as the soft tissue cleaners of FIGS. 14-18. Toothbrush 13020 includes a central pod 13058 that is substantially unitary and lacks elastomeric section 13055 of toothbrush 13000. Thus, the central pod can provide relatively firm engagement of oral features to be cleaned via the larger rigid central pod, while retaining benefits provided via its suspended configuration. As such, central pod can adapt to the cleaning forces applied to the head by moving fore, aft, sideways and/or downward with respect to the frame. However, its relatively large, rigid size can provide uniform orientation to a large number of cleaning members 13218 attached thereto.

Figure 23A:
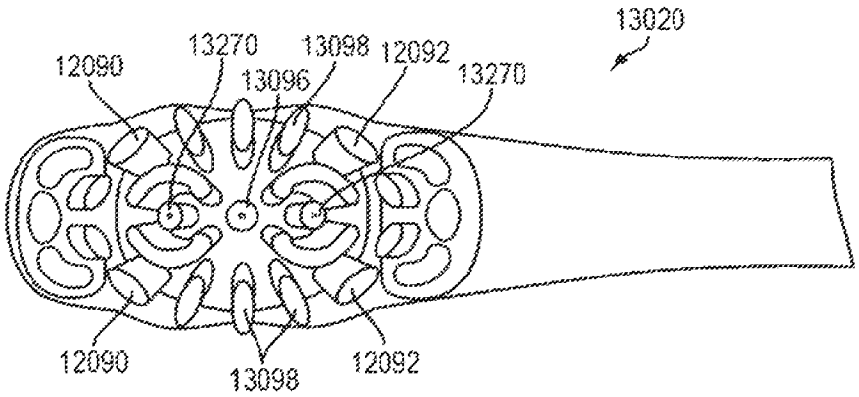
FIG. 23A is a top view of an oral care implement according to another embodiment of the invention.

Cleaning elements 13218 extending from the central pod are similar to the cleaning elements 12218 of toothbrush 12000 and generally include the same configuration, aspects and features as cleaning elements 12218 shown in FIG. 19. However, as central pod 13058 is single pod that spans about the same distance as central pods 12032 and 12034 of toothbrush 12000 in FIG. 19, central pod 13058 includes additional cleaning elements in its central region. As shown in FIG. 23A, a central columnar cleaning element 13096 is located at a central portion of the central pod, which is similar to columnar cleaning elements 12270 of toothbrush 12000. Columnar cleaning element 13096 cooperates with columnar cleaning elements 13270 to effectively penetrate and engage oral surfaces and gaps between surfaces and to transmit downward force to the central pod when excessive cleaning force is applied to the cleaning elements. In addition, several radial cleaning elements 13098 extend from the central columnar cleaning element 13096 in a generally spoke-like configuration at a central region of the central pod. Radial cleaning elements engage features to be cleaned throughout a central portion of the pod, which provide a perimeter structure at side portions of the central pod. The perimeter structure enhances engagement of oral features to be cleaned and can assist with retaining dentifrice within the cleaning elements of the central pod during use.

Figure 24A:
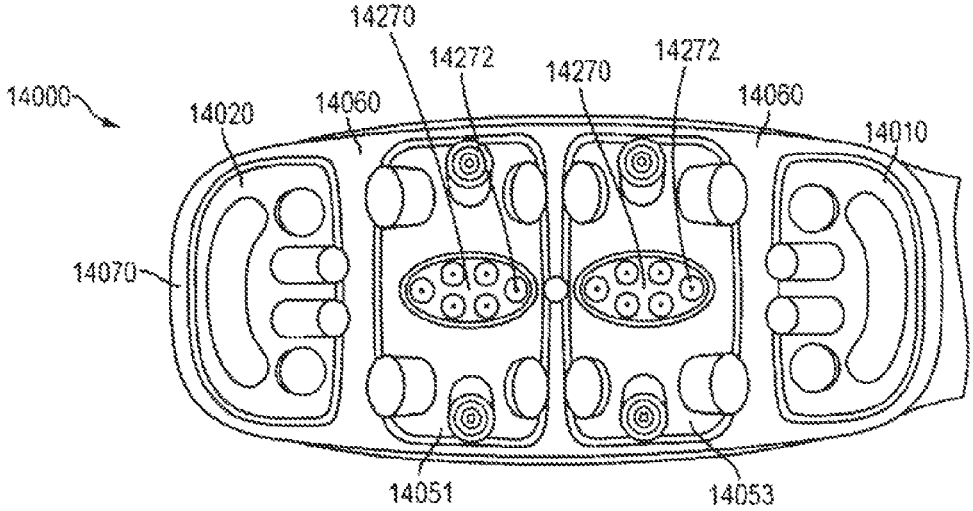
FIG. 24A is a top view of an oral care implement according to another embodiment of the invention.
Figure 24B:
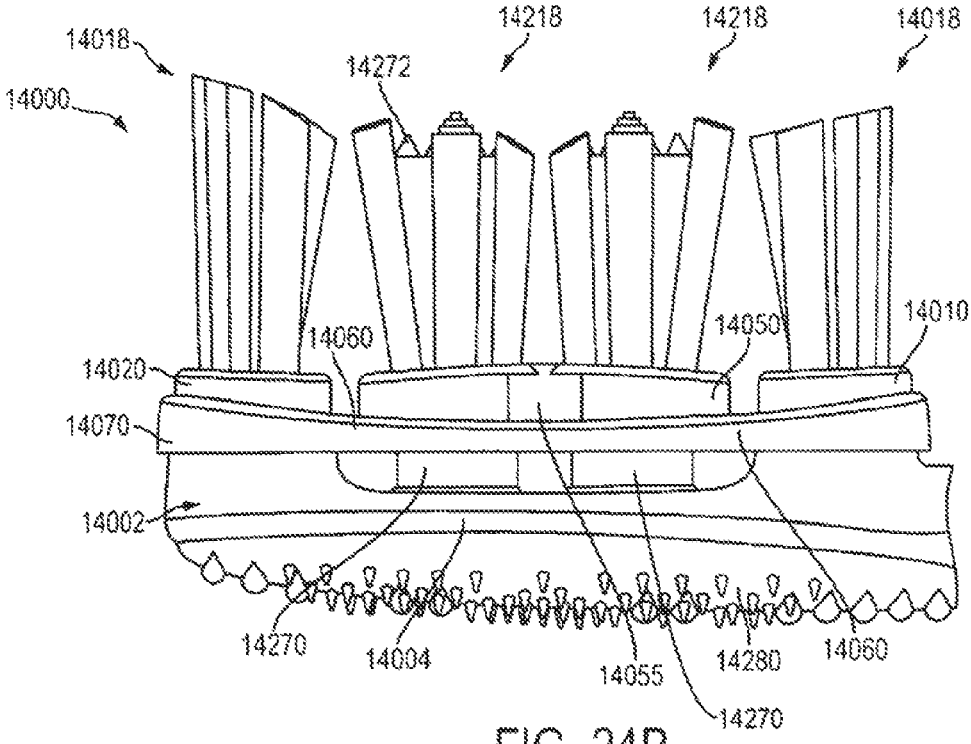
FIG. 24B is a side elevational view of the oral care implement of FIG. 24A.
Figure 25A:
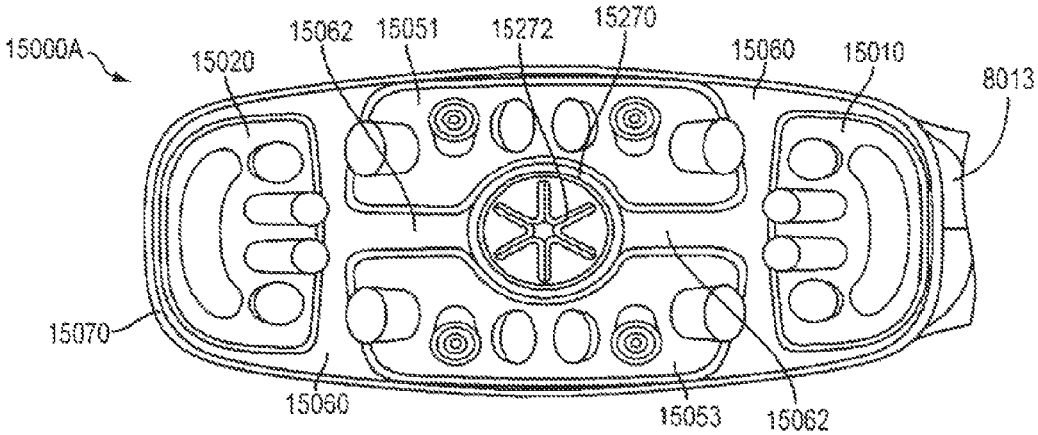
FIG. 25A is a top view of a head of an oral care implement according to another embodiment of the invention.
Figure 25B:
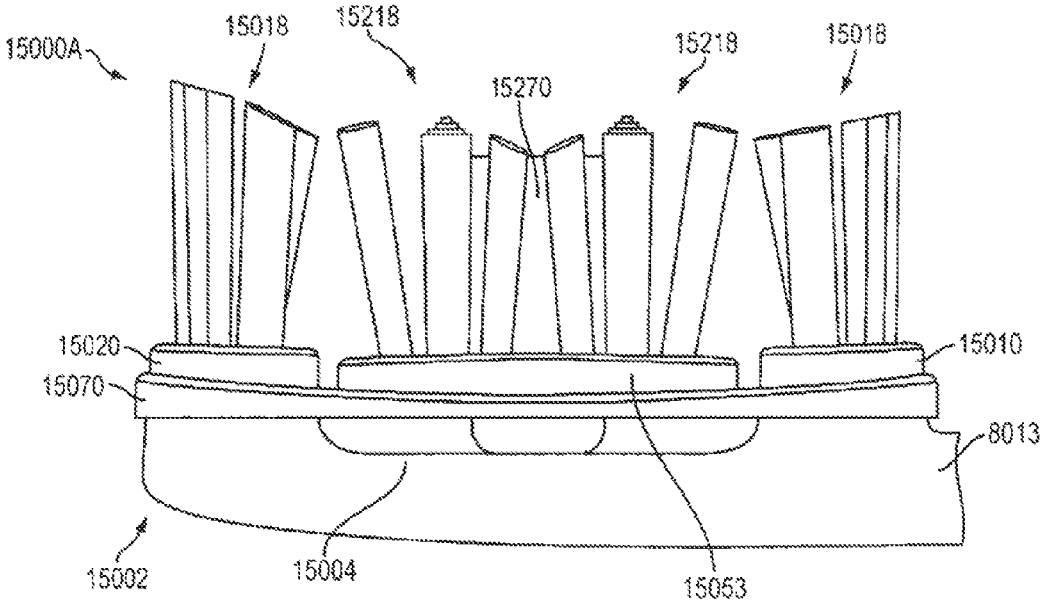
FIG. 25B is a side elevational view of the oral care implement of FIG. 25A.
Figure 25C:
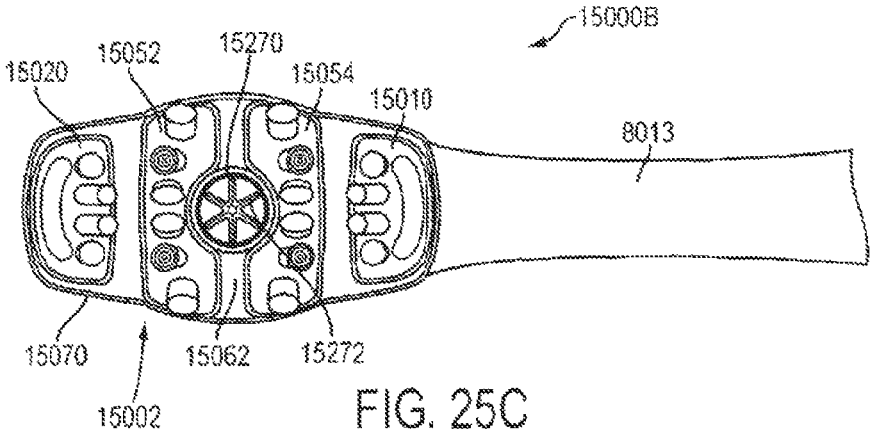
FIG. 25C is a top view of a head of an oral care implement according to another embodiment of the invention.
Figure 25D:
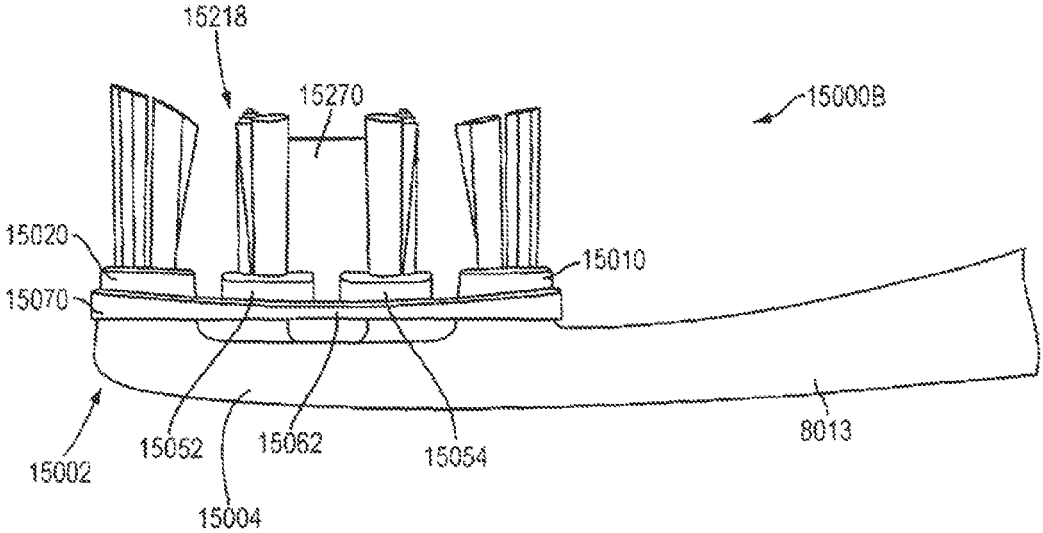
FIG. 25D is a side elevational view of the oral care implement of FIG. 25C.
Figure 25E:
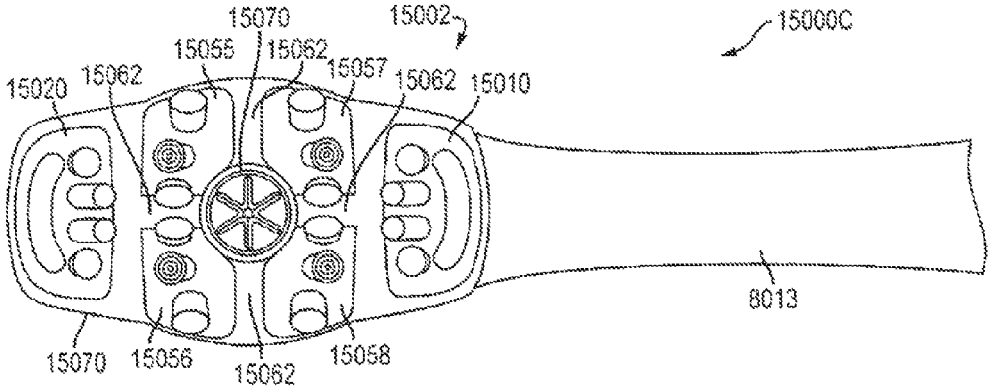
FIG. 25E is a top view of a head of an oral care implement according to another embodiment of the invention.

Referring now to FIGS. 24A and 24B, an oral care implement, in the form of a toothbrush 14000, is shown that is similar to the embodiment illustrated in FIG. 21 and comprises a handle (not shown) and a head 14002 having a combination of fixed and suspended cleaning elements. Head 14002 includes a frame 14004, proximal and distal pods 14010 and 14020 having cleaning elements 14018, and a single central pod 14050 suspended between the proximal and distal pods. The handle, head 14002 and proximal and distal pods 14010 and 14020 may be formed as a unitary construction from a thermoplastic, such as polypropylene. A soft tissue cleaner 14280 is generally the same as soft tissue cleaners 10280 and 12280 of FIGS. 10-13 and 19-20 respectively. However, various soft tissue cleaner configurations may be used, such as the soft tissue cleaners of FIGS. 14-18.

Central pod 14050 has an elastomeric section 14055 disposed in a middle portion of the central pod, or more particularly between a pair of pod segments. The elastomeric section is preferably made from a resilient material, such as a soft thermoplastic elastomer (TPE), while the central pod is preferably made from more rigid material, such as polypropylene. The central pod 14050 is held in place by a molded TPE membrane 14070 that connects with the proximal and distal pods 14010 and 14020 to form bridge supports 14060. The membrane 14070 may form a loop that encompasses the pair of fixed proximal and distal pods 14010 and 14020 and attaches to opposing sides of central pod 14050. Grooves (not shown) in side portions of the proximal and distal pods, as well as the central pod, may receive membrane 14070. In addition, membrane 14070 may be attached to the pods via an adhesive and/or a melt bond, for example.

The cleaning elements 14218 on the central pod 14050 are similar to the configuration of the cleaning elements shown in FIGS. 19 and 20, with the exception of a plurality of central, flexible cleaning elements 14270 extending from the frame 14004 and protruding through one or more openings (not shown) in the central pod 14050. Cleaning element 14270 further comprises massaging and/or polishing elements 14272 on its upper surface. While two cleaning elements 14270 are shown, it will be appreciated that only one, or more than two cleaning elements 14270 may be used as desired. Cleaning element 14270 may be attached to the frame 14004, or extend through the frame 14004 from the soft tissue cleaner 14280 on the opposite side of the head 14002. If the latter, the cleaning element 14270 may be molded simultaneously with the soft tissue cleaner 14280. In either case, a unitary structure defined by the membrane 14070 carrying pods 14010, 14020 and 14050, could be assembled to the base 14004 over the cleaning element(s) 14270. Other methods of construction are contemplated.

Membrane 14070 allows the central pod 14050 and cleaning elements 14218 to move toward frame 14004, guided by the cleaning elements 14270, when sufficient force is applied during a cleaning operation. Such movement provides additional functionality not described before. One such functionality is a tooth polisher in the middle of the head that is surrounded by fixed and movable cleaning elements 14018, 14218 respectively. In addition, the cleaning element 14270 includes massaging and/or polishing elements 14272 that are at a fixed height relative to the head 14004, yet are surrounded by cleaning elements 14218 that recede toward the head 14004 under brushing pressure, enabling the cleaning elements 14272 to be more efficacious during brushing.

When brushing pressure force is applied to the central pod 14050, segments 14051 and 14053 of the central pod 14050, as well as the cleaning elements 14270, will flex about the elastomeric section 14055. As a result, the cleaning elements 14218 extending from either end of the central pod 14050, as well as the cleaning elements 14270, can rotate toward one another. The central pod 14050 can flex back to its original position when the force on the central pod moving it toward the head 14002 diminishes.

Figure 23B:
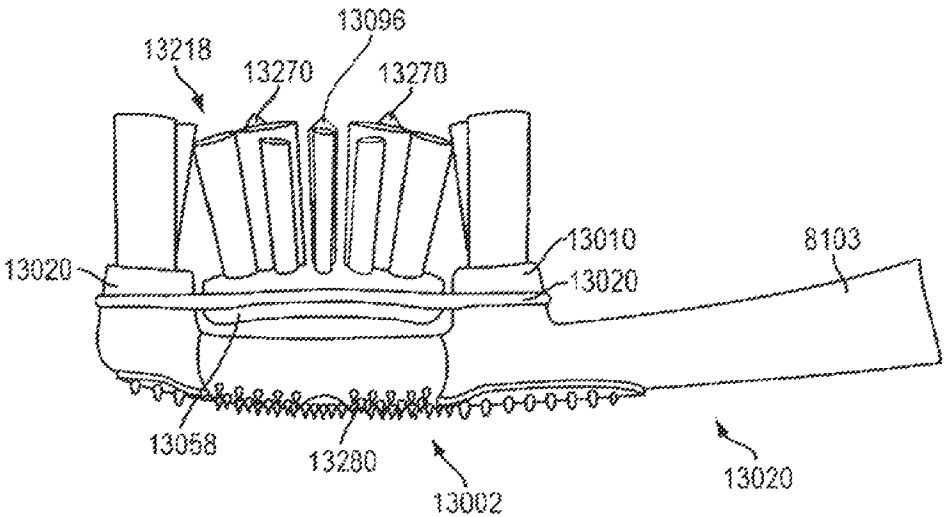
FIG. 23B is a side elevational view of the oral care implement of FIG. 23A.

Referring now to FIGS. 25A-25E, there is shown various head configurations for an oral care implement, in the form of toothbrushes 15000A-C, that are similar to the embodiment illustrated in FIGS. 23A and 23B and comprises a handle 8103 and a head 15002 having a combination of fixed and suspended cleaning elements. Head 15002 includes a frame 15004, proximal and distal pods 15010 and 15020 having cleaning elements 15018, and a central pod 15053 defined by pod segments 15051-15054 (embodiments of FIG. 25A through 25D) or pod segments 15055 through 15058 (embodiment of FIG. 25E) suspended between the proximal and distal pods. The handle 8103, head 15002 and proximal and distal pods 15010 and 15020 may be formed as a unitary construction from a thermoplastic, such as polypropylene.

The central pod segments 15051-15058 are held in place by a molded TPE membrane 15070 that connects with the proximal and distal pods 15010 and 15020 to form bridge supports 15060. The membrane 15070 may form a loop that encompasses the pair of fixed proximal and distal pods 15010 and 15020 and central pod segments 15051-15058, which segments may be separated by a flexible gap 15062 along the longitudinal axis (embodiment of FIGS. 25A and 25B) or lateral axis (embodiment of FIGS. 25C and 25D) of the head 15002. Alternatively, segments 15055-15058 of the embodiment of FIG. 25E may be separated by a flexible gap 15062 along both the longitudinal and lateral axes of the head. Grooves (not shown) in the pods may receive membrane 15070. In addition, membrane 15070 may be attached to the pods via an adhesive and/or a melt bond, for example.

The cleaning elements 15218 on the central pod segments are similar to the configuration of the cleaning elements shown in FIGS. 23A and 23B, with the exception of a central cleaning element 15270 having polishing ridges 15272 along its upper surface that protrudes through an opening (not shown) in the membrane 15070. Such cleaning element 15270 functions in a similar manner as cleaning element 14270 of FIGS. 24A and 24B, relative to the membrane 15070 and the central pod segments 15051, 15053 of FIGS. 25A and 25B. However, because the central pod segments 15051, 15053 are separated along the longitudinal axis of the head 15002 by a gap 15062, such segments 15051, 15053 will tend to rotate away from the protruding cleaning element 15270, or rotate around the cleaning element 15270, under brushing pressure, thereby simulating the movement of a bird's wings, resulting in increased efficacy and interproximal penetration. A similar movement is experienced along the transverse axis with segments 15052, 15054 of FIGS. 25C and 25D, and an even more extensive movement is experienced along the longitudinal and transverse axes with segments 15055-15058 of FIG. 25E. Thus, cleaning element 15270 provides a central pivot around which pod segments 15051-15058 can move.

Cleaning element 15270 may be attached to the frame 15004, or extend through the frame 15004 from a soft tissue cleaner (not shown) on the opposite side of the head 15002. If the latter, the cleaning element 15270 may be molded simultaneously with the soft tissue cleaner. In either case, a unitary structure defined by the membrane 15070 carrying pods 15010, 15020 and central pod 15050 segments 15051-15058, could be assembled to the base 15004 over the cleaning element 15270. Other methods of construction are contemplated.

Figure 26:
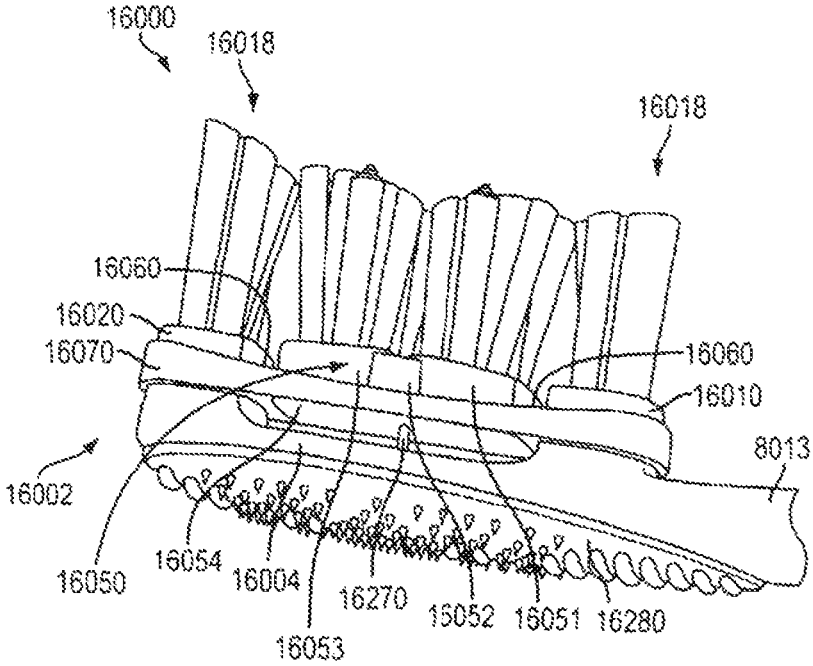
FIG. 26 is a bottom perspective view of a head of an oral care implement according to another embodiment of the invention.
Figure 27:
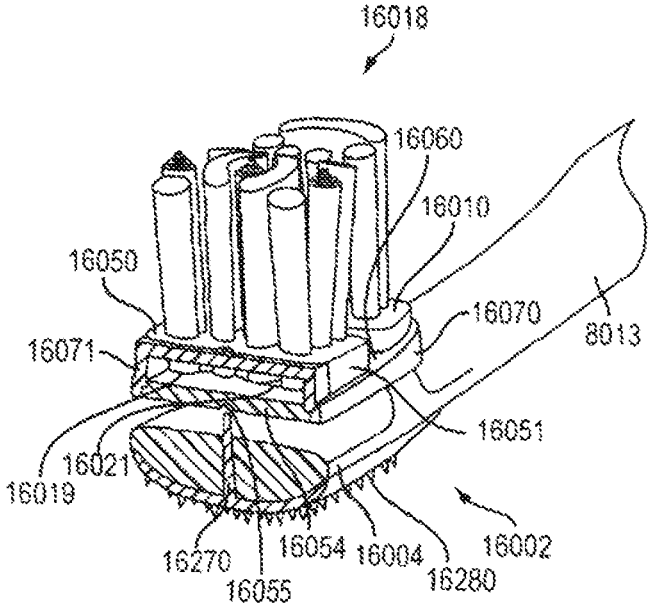
FIG. 27 is a cross-sectional view of the oral care implement of FIG. 26.

Referring now to FIGS. 26 and 27, an oral care implement, in the form of a toothbrush 16000, comprises a handle 8103 and a head 16002 having a combination of fixed and suspended cleaning elements. Head 16002 includes a frame 16004, proximal and distal pods 16010 and 16020 having cleaning elements 16018, and a central pod 16050 defined by pod segments 16051 and 16053 suspended between the proximal and distal pods. The handle 8103, head 16002 and proximal and distal pods 16010 and 16020 may be formed as a unitary construction from a thermoplastic, such as polypropylene.

The central pod segments 16051 and 16053 may be separated by a bridge 16052 that is preferably flexible and formed from the same material as a molded TPE membrane 16070 that connects with the proximal and distal pods 16010 and 16020 to form bridge supports 16060. The membrane 16070 may form a loop that encompasses the pair of fixed proximal and distal pods 16010 and 16020 and central pod 16050 including segments 16051 and 16053, which segments may be separated by a flexible gap 16052 along the lateral axis of the head 16002 and/or along the longitudinal axis as shown in other embodiments (see, for example, FIGS. 25A-25E). Grooves (not shown) in the pods may receive membrane 16070. In addition, membrane 16070 may be attached to the pods via an adhesive and/or a melt bond, for example.

Proximal and distal pods 16010 and 16020 may be integral with the head frame 16004, such that the membrane extends around the central portion of such pods, or the pods may terminate at the edge of the membrane 16070 (see the bottom of pod 16050 in FIG. 27) and be attachable to the head frame 16004 by ultrasonic welding, adhesive or the like. Accordingly, membrane 16070 may serve as an outer frame to a plate of cleaning elements included on pods 16010, 16020 and 16050, which plate may be attachable as a single unit to the head frame 16004. Thus, the pods 16010, 16020 and 16050 may be assembled and manipulated as a single unit and attachable to the head frame 16004 as a single unit at the proximal and distal ends of the head frame 16004.

FIG. 27 illustrates the construction of a portion of pod 16050, and more specifically a portion of pod 16051, wherein the bottoms 16019 of cleaning elements 16018 are melted to form a mat 16021, which mat 16021 is captured between a pod housing 16071 and floor 16054. The mat 16021 prevents the cleaning elements 16018 from passing through the tuft holes in the pod housing 16071. The floor 16054, for example, could be adhered or welded to the housing 16071 (thereby creating an enclosed internal space), with the floor 16054 being at least partially surrounded by the membrane 16070. Thus, the cleaning elements 16018 in this embodiment are captured and secured within the pod housing 16071 and floor 16054 in a manner known as anchor-free tufting (AFT), but such cleaning elements are not rigidly and securely fixed to any particular support structure in the manner of a stapled tuft secured within a tuft hole.

The cleaning elements 16018 on the proximal and distal pods 16010 and 16020 may be supported using an AFT process as described above, wherein they would be captured between the respective pod housing and the head frame, or they may be anchored to the pods 16010, 16020 if such pods constitute integral extensions of the head frame 16004. If they are provided using an AFT process, the connection between the pod housing and the head frame would constitute an edge connection, with the pod housing being welded, for example, to the head frame along the periphery of the pod housing to allow for the mat of melted bristle ends to reside between the pod housing and the head frame.

When brushing with the toothbrush of for example, FIGS. 22A-22B, that has a toothbrush head that is comprised of several areas with affixed cleaning elements (proximal and distal ends) interconnected with a flexible, central rubber-like field, the central area can bottom and touch the head frame below in an uncontrollable fashion (see FIG. 22B). As a result there may be a clanking noise, a significant "slippage/stretching" of the central portion of the flexible field with an imbedded block(s) of cleaning elements that may cause a damage either to the structure or to the user. By incorporating supports that protrude upwards from the brush head, the flexible field's movements can be controlled with an intent to enable the flexible field to move in a particular fashion relative to the brush head.

Figure 28:
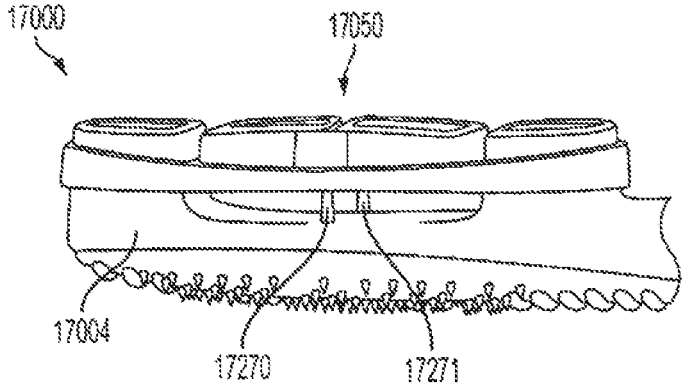
FIG. 28 is a side elevational view of the oral care implement according to another embodiment of the invention.
Figure 29:
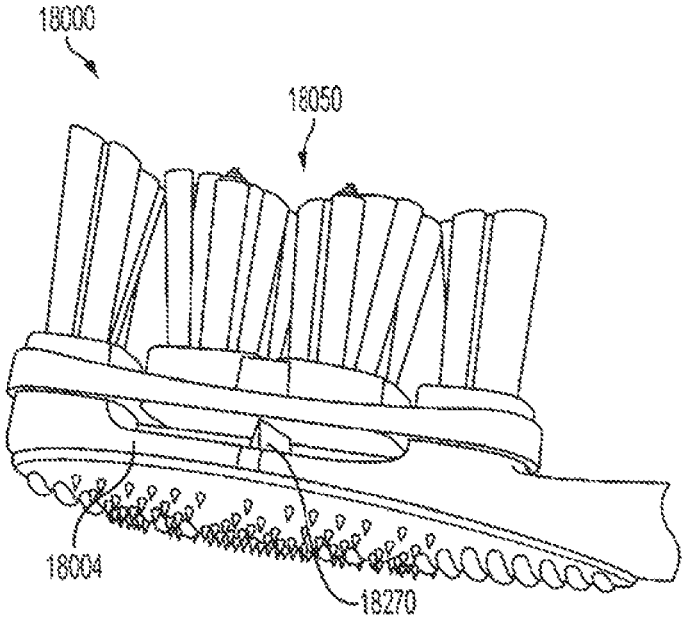
FIG. 29 is a bottom perspective view of a head of an oral care implement according to another embodiment of the invention.

FIGS. 26 and 27 illustrate one example of a single, central protrusion 16270 extending from a soft tissue cleaner 16280 on the back of the head 16002 to an optional depression or notch 16055 provided in the floor 16054 of the tuft block 16071. As shown in FIG. 27, the central protrusion 16270 may have a rounded head in contact with at least one central pod. Such protrusion 16270 is preferably formed or unitarily molded together with the soft tissue cleaner 16280 of a flexible material, although it does not have to be, and provides a pivot point for pod 16050. This enables pod 16050 to move in a controlled fashion relative to the head frame 16004. Depending on the flexibility of the protrusion 16270, pod 16050 may also be capable of normal movement or movement toward the head frame 16004 (again, see FIG. 22B for example). Alternatively, the protrusion 16270 may be rigid and extend from the head frame 16004 to provide a rigid pivot point that resists normal movement of the pod 16050 toward the center of the head frame 16004, while permitting a pivoting or rocking motion about the pivot. Or course, while a single, central protrusion 16270 is illustrated in FIGS. 26 and 27, the number and type of protrusions or supports may vary as shown in, but not limited to, FIG. 28 (multiple supports 17270 and 17271 extending between head frame 17004 and central pod 17050) and FIG. 29 (transverse bar support 18270 extending from the head frame 18004 along the transverse axis of the central pod 18050 of toothbrush 18000, making line contact with the central pod 18050). Each of the embodiments of FIGS. 26-29 enables unique movement of the flexible pod relative to the head frame, with the structure illustrated in FIGS. 26-27 enabling at least a 360 degree pivot, the structure illustrated in FIG. 28 enabling a more restrictive pivoting movement, and the structure illustrated in FIG. 29 enabling a rocking movement over protrusion 18270.

As various changes could be made in the above without departing from the scope of the invention, it is intended that all matter contained in this application, including all mechanisms and/or modes of interaction described above, shall be interpreted as illustrative only and not limiting in any way the scope of the appended claims. Further, as noted above, it is intended that oral care implements according to the invention and associated methods may utilize various combinations of aspects, features and configurations discussed within the application.

What is claimed is:

1. An oral care implement comprising:

a handle;

a head coupled to the handle, the head having a longitudinal axis and a base structure with a front surface;

a cleaning element carrier supported above the front surface of the base structure so that a gap exists between the cleaning element carrier and the base structure, the cleaning element carrier comprising a first longitudinal segment and a second longitudinal segment that are spaced apart by a longitudinal gap;

a plurality of first cleaning elements extending from a top surface of the cleaning element carrier;

at least one second cleaning element extending from the front surface of the base structure;

wherein an axis that is transverse, to the longitudinal axis of the head intersects both the second cleaning element and the cleaning element carrier; and wherein the at least one second cleaning element protrudes through the longitudinal gap between the first and second longitudinal segments of the cleaning element carrier.

2. The oral care implement of claim 1 wherein the at least one second cleaning element extends from the front surface of the base structure beyond the top surface of the cleaning element carrier.

3. The oral care implement of claim 1 wherein the cleaning element carrier is supported above the base structure by at least one pod extending, from the base structure.

4. The oral care implement of claim 1 further comprising a plurality of the at least one second cleaning elements extending from the front surface of the base structure beyond the top surface of the cleaning element carrier.

5. The oral care implement of claim 1 wherein the first and second longitudinal segments of the cleaning element carrier are located on opposite sides of the longitudinal axis of the head.

6. The oral care implement of claim 1 wherein at least one of the first cleaning elements is out of transverse alignment with the at least one second cleaning element.

7. The oral care implement of claim 1 further comprising:

a distal pod extending from the front surface of the base structure, wherein the cleaning element carrier is at least partially supported above the front surface of the base structure by the distal pod;

wherein the distal pod is static relative to the base structure and the cleaning element carrier is movable relative to the base structure in a direction towards the front surface of the base structure;

the first and second longitudinal segments of the cleaning element carrier located on opposite sides of the longitudinal axis of the head;

a plurality of the at least one second cleaning elements extending from the front surface of the base structure beyond the top surface of the cleaning element carrier, the plurality of at least one second cleaning elements positioned along the longitudinal axis of the head between the first and second longitudinal segments of the cleaning element carrier and protruding through the longitudinal gap between the first and second longitudinal segments of the cleaning element carrier;

at least one of the first cleaning elements extending from the first longitudinal segment of the cleaning element carrier and at least one of the first cleaning elements extending from the second longitudinal segment of the cleaning element carrier; and wherein a second axis that is transverse to the longitudinal axis of the head intersects both the at least one of the first cleaning elements extending from the first longitudinal segment of the cleaning element carrier and the at least one of the first cleaning elements extending from the second longitudinal segment of the cleaning element carrier.

8. An oral care implement comprising:

a handle;

a head coupled to the handle, the head having a longitudinal axis and a base structure with a front surface;

a cleaning element carrier supported above the front surface of the base structure so that a gap exists between the cleaning element carrier and the base structure, the cleaning element carrier comprising a first longitudinal segment and a second longitudinal segment that are spaced apart by a longitudinal gap;

a plurality of first cleaning elements extending from a top surface of the cleaning element carrier;

at least one second cleaning element extending from the front surface of the base structure;

wherein an axis that is transverse to the longitudinal axis of the head intersects both the second cleaning element and the cleaning element carrier;

wherein the first and second longitudinal segments of the cleaning element carrier are located on opposite sides of the longitudinal axis of the head; and wherein the at least one second cleaning element is positioned along the longitudinal axis of the head between the first and second longitudinal segments of the cleaning element carrier.

9. An oral care implement comprising:

a handle;

a head coupled to the handle, the head having a longitudinal axis and a base structure with a front surface;

a cleaning element carrier supported above the front surface of the base structure so that a gap exists between the cleaning element carrier and the base structure, the cleaning element carrier comprising a first longitudinal segment and a second longitudinal segment that are spaced apart by a longitudinal gap;

a plurality of first cleaning elements extending from a to surface of the cleaning element carrier;

at least one second cleaning element extending from the front surface of the base structure;

wherein an axis that is transverse to the longitudinal axis of the head intersects both the second cleaning element and the cleaning element carrier; and a resilient material at least partially filling the longitudinal gap.

10. An oral care implement comprising:

a handle;

a head coupled to the handle, the head having a longitudinal axis and a base structure with a front surface;

a cleaning element carrier having a top surface and a bottom surface, the cleaning element carrier supported above the front surface of the base structure so that a gap exists between the bottom surface of the cleaning element carrier and the front surface of the base structure;

a plurality of first cleaning elements extending from the top surface of the cleaning element carrier;

at least one second cleaning element extending from the front surface of the base structure beyond the top surface of the cleaning element carrier;

wherein an axis that is transverse to the longitudinal axis of the head intersects both the second cleaning element and the cleaning element carrier; and wherein the first cleaning elements have distal ends that are spaced a first distance from the front surface of the base structure and the at least one second cleaning element has a distal end that is spaced a second distance from the front surface of the base structure, the first distance being greater than the second distance.

11. The oral care implement of claim 10 further comprising a distal pod extending from the front surface of the base structure, wherein the cleaning element carrier is at least partially supported above the front surface of the base structure by the distal pod.

12. The oral care implement of claim 10 wherein the at least one second cleaning element protrudes through an opening in the cleaning element carrier.

13. The oral care implement of claim 10 wherein the cleaning element carrier comprises a first longitudinal segment and a second longitudinal segment located on opposite sides of the longitudinal axis of the head.

14. The oral care implement of claim 10 further comprising:

a distal pod extending from the front surface of the base structure, wherein the cleaning element carrier is at least partially supported above the front surface of the base structure by the distal pod;

wherein the distal pod is static relative to the base structure and the cleaning element carrier is movable relative to the base structure;

wherein the cleaning element carrier comprises a first longitudinal segment and a second longitudinal segment located on opposite sides of the longitudinal axis of the head;

wherein at least one of the first cleaning elements extends from the first longitudinal segment of the cleaning element carrier and at least one of the first cleaning elements extends from the second longitudinal segment of the cleaning element carrier; and wherein the at least one second cleaning element extends from the front surface of the base structure along the longitudinal axis of the head to a position beyond the top surface of the cleaning element carrier.

15. An oral care implement comprising:

a handle;

a head coupled to the handle, the head having a longitudinal axis and a base structure with a front surface;

a cleaning element carrier having a to surface and a bottom surface the cleaning element carrier supported above the front surface of the base structure so that a gap exists between the bottom surface of the cleaning element carrier and the front surface of the base structure;

a distal pod extending from the front surface of the base structure, wherein the cleaning element carrier is at least partially supported above the front surface of the base structure by the distal pod;

a plurality of first cleaning elements extending from the top surface of the cleaning element carrier;

at least one second cleaning element extending from the front surface of the base structure beyond the top surface of the cleaning element carrier;

wherein an axis that is transverse to the longitudinal axis of the head intersects both the at least one second cleaning element and the cleaning element carrier; and wherein the distal pod is static relative to the base structure and the cleaning element carrier is movable relative to the base structure in a direction towards the front surface of the base structure.

16. An oral care implement comprising:

a handle;

a head coupled to the handle, the head having a longitudinal axis and a base structure with a front surface;

a cleaning element carrier having a to surface and a bottom surface, the cleaning element carrier supported above the front surface of the base structure so that a gap exists between the bottom surface of the cleaning element carrier and the front surface of the base structure;

a plurality of first cleaning elements extending from the top surface of the cleaning element carrier;

at least one second cleaning element extending from the front surface of the base structure beyond the top surface of the cleaning element carrier;

wherein an axis that is transverse to the longitudinal axis of the head intersects both the at least one second cleaning element and the cleaning element carrier;

wherein the cleaning element carrier comprises a first longitudinal segment and a second longitudinal segment located on opposite sides of the longitudinal axis of the head; and wherein the at least one second cleaning element extends from the front surface of the base structure along the longitudinal axis of the head.

17. The oral care implement of claim 16 wherein at least one of the first cleaning elements extends from the first longitudinal segment of the cleaning element carrier and at least one of the first cleaning elements extends from the second longitudinal segment of the cleaning element carrier.

18. An oral care implement comprising:

a handle;

a head coupled to the handle, the head having a longitudinal axis and a base structure with a front surface;

a cleaning element carrier supported above the front surface of the base structure so that a gap exists between a bottom surface of the cleaning element carrier and the from surface of the base structure, the cleaning element carrier comprising a first longitudinal segment and a second longitudinal segment that are spaced apart along the longitudinal axis of the head by a longitudinal gap;

a plurality of first cleaning elements extending from a top surface of the cleaning element carrier; and at least one second cleaning element extending from the front surface of the base structure along the longitudinal axis of the head, the at least one second cleaning element protruding through the longitudinal gap.

* * * * *